US007792462B2

(12) United States Patent
Iwasaki et al.

(10) Patent No.: US 7,792,462 B2
(45) Date of Patent: Sep. 7, 2010

(54) IMAGE FORMATION APPARATUS WITH TONER RETENTION MEMBER

(75) Inventors: Jin Iwasaki, Ebina (JP); Koya Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/314,295

(22) Filed: Dec. 8, 2008

(65) Prior Publication Data

US 2009/0103941 A1 Apr. 23, 2009

Related U.S. Application Data

(62) Division of application No. 11/374,985, filed on Mar. 15, 2006, now Pat. No. 7,603,058.

(30) Foreign Application Priority Data

Mar. 16, 2005 (JP) ..... 2005-075011
Jun. 23, 2005 (JP) ..... 2005-183888
Feb. 10, 2006 (JP) ..... 2006-033813

(51) Int. Cl.
*G03G 21/00* (2006.01)

(52) U.S. Cl. ..... 399/129; 300/150; 300/349

(58) Field of Classification Search ..... 399/100, 399/129, 149, 150, 344, 349, 353
See application file for complete search history.

(56) References Cited

U.S. PATENT DOCUMENTS 5,200,789 A * 4/1993 Oshiumi ..... 399/18
5,678,142 A 10/1997 Saegusa ..... 399/129
5,701,559 A 12/1997 Ootaka et al. ..... 399/149
5,740,494 A * 4/1998 Shoji et al. ..... 399/71
5,832,336 A * 11/1998 Kawasaki et al. ..... 399/71
6,029,033 A * 2/2000 Kawasaki ..... 399/149
6,400,918 B1 * 6/2002 Ishii et al. ..... 399/149
6,871,030 B2 3/2005 Nishimura ..... 399/98
7,221,890 B2 5/2007 Nishimura ..... 399/149

FOREIGN PATENT DOCUMENTS

JP 2001-100493 A 4/2001
JP A-2001-215799 8/2001
JP A-2001-249592 9/2001
JP A-2002-258666 9/2002
JP A-2003-333805 11/2003
JP 2004-198957 A 7/2004

* cited by examiner

*Primary Examiner*—Robert Beatty
(74) *Attorney, Agent, or Firm*—Morgan, Lewis & Bockius LLP

(57) ABSTRACT

An image formation apparatus which includes a rotating image-bearing body, a charging section, an exposure section, a developing section, a transfer section, and a residue toner-charging section. The charging section charges the image-bearing body. The exposure section forms an electrostatic latent image on the image-bearing body that has been charged. The developing section develops the electrostatic latent image and forms a toner image. The transfer section transfers the toner image to a transfer body. The residue toner-charging section is provided upstream of the charging section and downstream of the transfer section and, after the transfer, charges transfer residue toner to a normal polarity. The transfer residue toner that has been charged to the normal polarity by the residue toner-charging section is recycled at the developing section. The residue toner-charging section is provided with a nonwoven fabric, which features conductivity and touches against the image-bearing body.

30 Claims, 31 Drawing Sheets

FIG.6

| FIBER DIAMETER $\phi$ | IMAGE AFTER 50,000 SHEETS |
|---|---|
| 0.1 $\mu$m | × |
| 0.5 $\mu$m | △ |
| 1.0 $\mu$m | ○ |
| 5.0 $\mu$m | ○ |
| 10.0 $\mu$m | ○ |
| 15.0 $\mu$m | ○ |
| 20.0 $\mu$m | ○ |
| 25.0 $\mu$m | △ |
| 30.0 $\mu$m | × |

FIG.17

SHOULDER+40%

| | NONWOVEN FABRIC | BRUSH |
|---|---|---|
| CHARGING VARIATION PRIOR TO PASSING CHARGER | 40v | 130v |
| CHARGING VARIATION AFTER PASSING CHARGER | 12v | 13v |

FIG.18

SHOULDER+7%

| | NONWOVEN FABRIC | BRUSH |
|---|---|---|
| CHARGING VARIATION PRIOR TO PASSING CHARGER | 40v | 130v |
| CHARGING VARIATION AFTER PASSING CHARGER | 12v | 25v |

FIG.30

| TONER RETENTION AMOUNT | IMAGE DELETION | |
|---|---|---|
| | DURING CONTINUOUS PAPER-FEEDING AND JUST AFTER CONTINUOUS PAPER-FEEDING | AFTER LONG-DURATION STANDING |
| 0mg/m$^2$ | × | × |
| 2g/m$^2$ | × | × |
| 4g/m$^2$ | ○ | × (○:AT REMOVAL MODE) |
| 10g/m$^2$ | ○ | ○ |
| 20g/m$^2$ | ○ | ○ |
| 100g/m$^2$ | ○ | ○ |
| 150g/m$^2$ | ○ | ○ |
| 200g/m$^2$ | ○ | ○ |
| 250g/m$^2$ | ○ | ○ |
| 300g/m$^2$ | ○ | × (○:AT REMOVAL MODE) |
| 350g/m$^2$ | × | × |

IMAGE FORMATION APPARATUS WITH TONER RETENTION MEMBER

CROSS-REFERENCE TO RELATED APPLICATION

This application is a Divisional of U.S. patent application Ser. No. 11/374,985, filed in the United States on Mar. 15, 2006, now U.S. Pat. No. 7,603,058 and claims priority under 35 USC 119 from Japanese Patent Application Nos. 2005-075011; 2005-183888; and 2006-033813, filed in Japan on Mar. 16, 2005, Jun. 23, 2005, and Feb. 10, 2006, respectively, all of which are hereby incorporated by reference in their entirety.

FIELD OF THE INVENTION

The present invention relates to an image formation apparatus.

DESCRIPTION OF THE RELATED ART

In an electrophotographic-system image formation apparatus, transfer residue toner which is left on a photosensitive drum is ordinarily scraped off and removed with a cleaning blade.

However, rather than providing a dedicated cleaning mechanism section such as a cleaning blade or the like, a cleanerless system has been proposed which, by optimizing specification conditions of a developing bias potential at a developing section, simultaneously performs development and recovering (cleaning) with the developing section.

Such a cleanerless system is provided with residue toner-charging means for charging the transfer residue toner to a normal polarity. As the residue toner-charging means, a residue toner charger 300 has been proposed (see, for example, Japanese Patent Application Laid-Open (JP-A) No. 2001-215799), with a structure which touches a conductive fixed brush 302 against a photosensitive drum 12, as shown in FIG. 10.

However, with the fixed brush 302, removal by the charger of discharge products, which are generated at times of electrostatic discharges at the photosensitive body, is difficult. Consequently, as would be expected, this may lead to image defects. In particular, in an AC+DC contact charging system, in which alternating current is superposed with direct current, because direct discharges to the photosensitive drum 12 are implemented, large amounts of discharge products adhere to a surface of the photosensitive drum 12. Consequently, there will often be problems with running of images (deletion) in high-temperature, high-humidity environments.

Now, as a means for solving such problems, a method of removing discharge products by raising an abutting pressure of a distal end of the fixed brush 302 against the photosensitive drum 12 has been considered. However, when the distal end of the fixed brush 302 is strongly touched against the photosensitive drum 12 in such a manner, damage (scratches) to the surface of the photosensitive drum 12 will be caused, and toner-filming, in which toner adheres to the surface, will result.

Moreover, when a voltage is applied to the fixed brush 302 for charging the transfer residue toner to the normal polarity, the photosensitive drum 12 is charged at the same time. Such charging of the photosensitive drum 12 by the fixed brush 302 causes very great variations in charging. The photosensitive drum 12 is charged to a final required potential by a contact charger 13, but if there are such charging variations at this time, the charging variations will still be present at the required potential. As a result, density variations and the like will arise in images of halftones and the like, and excellent images will not be obtained. Accordingly, it is necessary to raise a charging capability of the contact charger 13.

Correspondingly, structures in which two fixed brushes are arranged in a series have been disclosed (see, for example, JP-A No. 2002-099176).

However, with a structure in which two brushes are lined up in such a manner, extra space is required for provision of the second fixed brush, in addition to which costs are higher.

Moreover, because distal portions of bristles of the brushes are in point contact at high pressures, charge injection effects cause charging variations, which leads to a rise in charging potentials at such regions. Therefore, even when these two brushes are arranged, charge variations beyond the fixed brushes cannot be satisfactorily eliminated.

Anyway, for a system in which transfer residue toner that is left on a photosensitive drum is scraped off and removed with a cleaning blade, a method has been proposed in which a nonwoven fabric is caused to touch against a downstream side relative to the cleaning blade, and large amounts of discharge products which have adhered to the surface of the photosensitive drum 12 are removed with the nonwoven fabric (see, for example, JP-A numbers 2002-258666 and 2003-333805).

Alternatively, as shown in FIG. 27, a structure has been proposed (see, for example, JP-A number 2001-249592) in which a nonwoven fabric 900 is disposed at a downstream side relative to transfer, which nonwoven fabric 900 is wound in one direction such that a fresh surface thereof touches against a photosensitive body 902.

However, when such a nonwoven fabric is used, there is a limit to discharge products that can be removed, and it is not possible to satisfactory eliminate running of images (deletion) in high-temperature, high-humidity environments. Moreover, if an abutting pressure of the nonwoven fabric is made very high in order to enhance discharge product removal characteristics, filming and scratching (damage) occur and, obviously, excellent images cannot be obtained.

SUMMARY OF THE INVENTION

In consideration of the problems described above, the present invention provides an image formation apparatus which provides excellent images over long periods.

An image formation apparatus of a first aspect of the present invention includes: an image-bearing body that rotates; a charging section that charges the image-bearing body; an exposure section that forms an electrostatic latent image on the image-bearing body that is charged; a developing section that develops the electrostatic latent image and forms a toner image; a transfer section that transfers the toner image to a transferred body; and a residue toner-charging section that is provided upstream of the charging section and downstream of the transfer section, and that charges transfer residue toner after transferring to a normal polarity, wherein the transfer residue toner that is charged to the normal polarity by the residue toner-charging section is recovered at the developing section, and the residue toner-charging section includes a conductive nonwoven fabric, that contacts the image-bearing body.

The image formation apparatus of the first aspect of the present invention is a "cleanerless system" image formation apparatus which recovers transfer residue toner, which has been charged to the normal polarity by the residue toner-charging section, at the developing section. Further, the residue toner-charging section is provided with a nonwoven fabric which features conductivity and touches against the image-bearing body.

Because the nonwoven fabric has a high fiber density, a transfer residue toner retention capability is high (i.e., large amounts of residue toner can be retained).

Therefore, a charging capability for charging the transfer residue toner to the normal polarity is high. Consequently, problems due to transfer residue toner not being charged to the normal polarity, for example, image problems due to recovering failures at the developing section and the like, are avoided.

The transfer residue toner which is retained in large amounts is effective for removal of discharge products which are generated at times of charging the surface of the image-bearing body. Consequently, problems due to adherence of discharge products and image running (deletion) can be avoided.

Thus, because the nonwoven fabric with a high retention capability for retaining transfer residue toner is provided at the residue toner-charging section, excellent images are provided at low cost with efficient use of space.

Further, when the transfer residue toner is charged to the normal polarity, the image-bearing body is also charged. Because a surface of the nonwoven fabric is evenly abutted against the image-bearing body, charging variations are small. Therefore, there is no need to raise a charging capability of the charging section more than is necessary.

An image formation apparatus of a second aspect of the present invention includes: an image-bearing body that rotates; a charging section that charges the image-bearing body; an exposure section that forms an electrostatic latent image on the image-bearing body that is charged; a developing section that develops the electrostatic latent image and forms a toner image; a transfer section that transfers the toner image to a transferred body; and a toner retention member that is provided at an upstream side of the charging section and a downstream side of the transfer section, and that contacts against the image-bearing body and retains transfer residue toner at a contact surface.

In the image formation apparatus of the second aspect of the present invention, the toner retention member retains transfer residue toner at the surface of contact with the image-bearing body. The retained transfer residue toner improves a capability for removal of adherents which have adhered to the image-bearing body, for example, discharge products which have been generated and adhered at times of charging. Consequently, failures due to adherents, for example, image deletion due to discharge products and the like, can be avoided. As a result, excellent images can be formed over long periods.

According to the present invention as described above, because adherents which have adhered to an image-bearing body are removed by a toner retention member which retains toner, excellent images can be provided over long periods.

BRIEF DESCRIPTION OF THE DRAWINGS

FIG. 6 is a table showing a relationship between a fiber diameter of fibers of a nonwoven fabric of the residue toner charger and images after printing of 50,000 sheets.

FIG. 17 is a table showing charging potentials when an AC voltage which is applied to a contact charger is a shoulder+40%.

FIG. 18 is a table showing charging potentials when an AC voltage which is applied to contact chargers is the shoulder+7%.

FIG. 30 is a table showing results of trial 2.

DETAILED DESCRIPTION OF THE INVENTION

Figure 1:
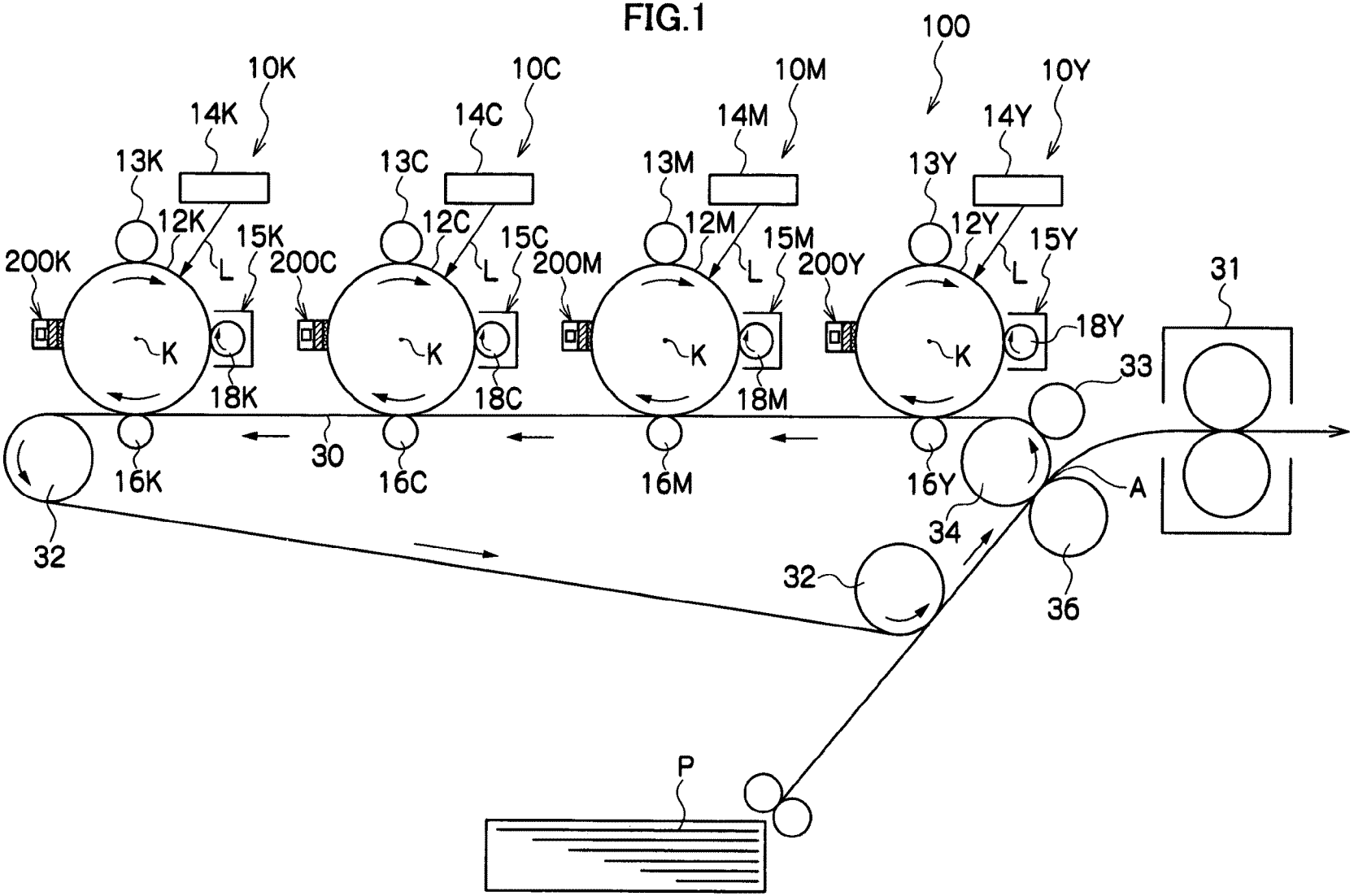
FIG. 1 is a diagram schematically showing structure of an image formation apparatus relating to a first embodiment of the present invention.

FIG. 1 shows an image formation apparatus 100 relating to a first embodiment of the present invention.

The image formation apparatus 100 performs image processing in accordance with color image information, which is transmitted thereto from an unillustrated image data input device such as a personal computer or the like, and forms a color image at recording paper P with an electrophotographic system.

The image formation apparatus 100 is equipped with image-forming units 10Y, 10M, 10C and 10K, which form toner images of the colors yellow (Y), magenta (M), cyan (C) and black (K), respectively. Hereafter, where it is necessary to distinguish between Y, M, C and K, descriptions will be given with one of 'Y', 'M', 'C' and 'K' appended to reference numerals, and where there is no need to distinguish between Y, M, C and K, the letters 'Y', 'M', 'C' and 'K' will be omitted.

The image-forming units 10Y, 10M, 10C and 10K are arranged in a row, in the order image-forming unit 10Y, image-forming unit 10M, image-forming unit 10C and image-forming unit 10K, along a direction of progress of an endless-form intermediate transfer belt 30, which is tensioned between a backup roller 34 and plural tension rollers 32. The intermediate transfer belt 30 passes between photosensitive drums 12Y, 12M, 12C and 12K, which serve as image-bearing bodies of the respective image-forming units 10Y, 10M, 10C and 10K, and primary transfer rollers 16Y, 16M, 16C and 16K, which are arranged to oppose the photosensitive drums 12Y, 12M, 12C and 12K, respectively.

Next, structures and image-forming operations of the image-forming units 10Y, 10M, 10C and 10K will be described, by reference to the image-forming unit 10Y which forms yellow toner images.

Figure 2:
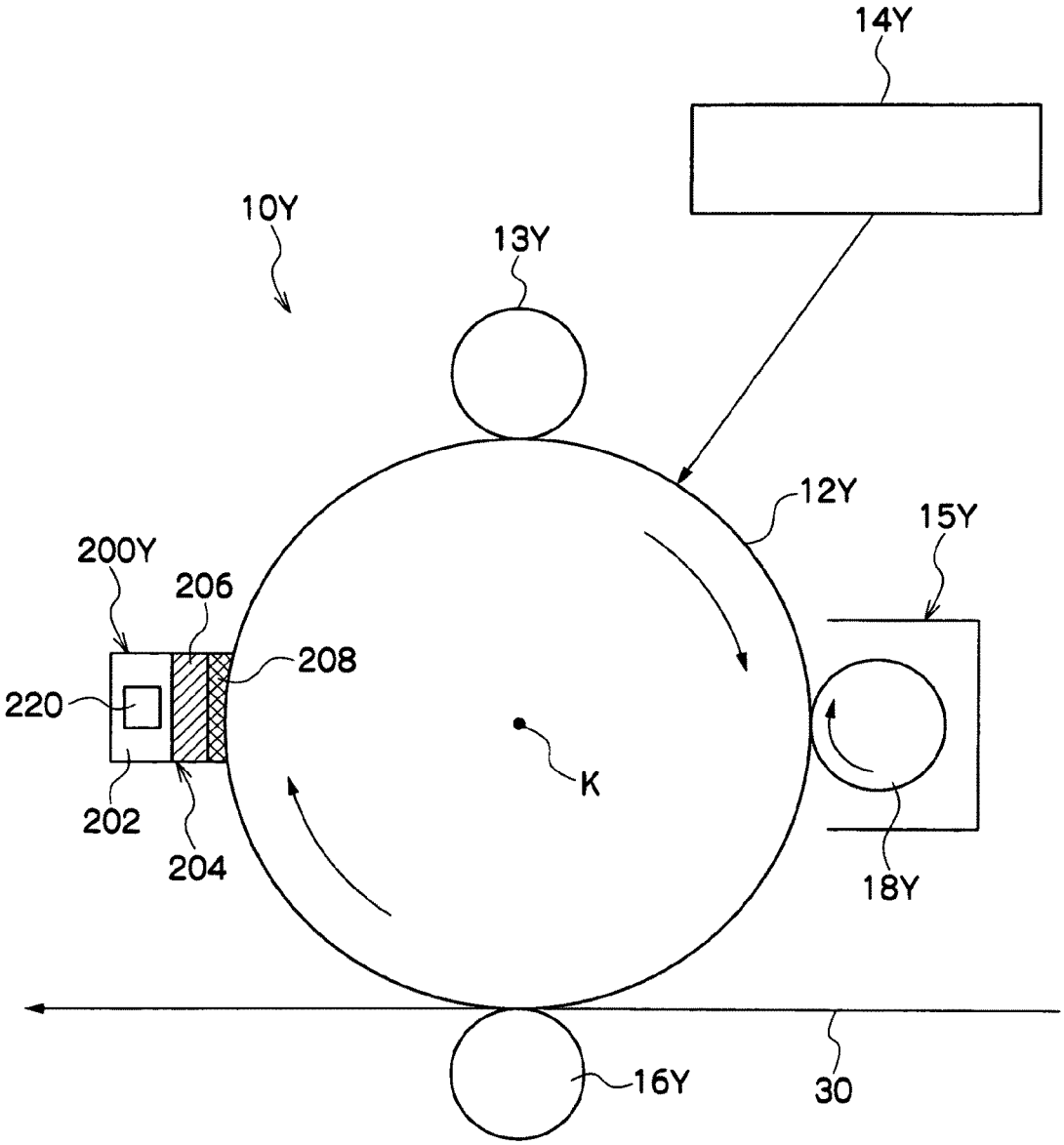
FIG. 2 is a diagram showing an image-forming unit of the image formation apparatus relating to the first embodiment of the present invention.

As shown in FIG. 2, a surface of the photosensitive drum 12Y is uniformly charged by the contact charger 13Y. Then, image exposure corresponding to a yellow image is performed by an exposure apparatus 14Y, and an electrostatic latent image corresponding to the yellow image is formed at the surface of the photosensitive drum 12Y.

The electrostatic latent image corresponding to the yellow image is developed with toner, which is carried thereto by a developing roller 18Y of a developing apparatus 15Y, to which a developing bias is applied, and a yellow toner image is formed. The yellow toner image is primary-transferred onto the intermediate transfer belt 30 by pressure force of the primary transfer roller 16Y and an electrostatic attraction force which is caused by a transfer bias applied to the primary transfer roller 16Y Then, the surface of the photosensitive drum 12Y is charged again by the contact charger 13Y, for the next image formation cycle.

Now, in the primary transfer, the yellow toner image is not completely transferred to the intermediate transfer belt 30, and a portion thereof remains at the photosensitive drum 12 as transfer residue yellow toner. The transfer residue yellow toner that is left at the photosensitive drum 12Y is retained by temporarily a residue toner charger 200Y (which will be described in detail later), is charged to a normal polarity, and adheres to the photosensitive drum 12. Then, the transfer residue yellow toner is recovered at the developing roller 18Y (cleaning) simultaneously with development at the developing apparatus 15Y.

That is, rather than including a dedicated cleaning mechanism section for removing transfer residue toner on the photosensitive drum 12, the image formation apparatus 100 uses a "cleanerless system" in which, with setting conditions of the development bias of the developing roller 18 of the developing apparatus 15 being optimized, development and recovering (cleaning) of the transfer residue toner are performed simultaneously by the developing apparatus 15.

Anyway, in the image formation apparatus 100, with timings in consideration of differences in the relative positions of the image-forming units 10Y, 10M, 10C and 10K as shown in FIG. 1, image-forming processes are performed by the respective image-forming units 10Y, 10M, 10C and 10K in the same manner as described above, and toner images of Y, M, C and K are sequentially superposed on the intermediate transfer belt 30 to form a full-color toner image.

Then, the recording paper P is conveyed to a secondary transfer position A with a predetermined timing, and the full-color toner image is together transferred from the intermediate transfer belt 30 to the recording paper P by an electrostatic attraction force of a secondary transfer roller 36 to which a transfer bias is applied.

The recording paper P to which the full-color toner image has been transferred is separated from the intermediate transfer belt 30, after which the recording paper P is conveyed to a fixing apparatus 31, and the full color toner image is fixed to the recording paper P by heat and pressure.

Transfer residue toner on the intermediate transfer belt 30 that is not transferred to the recording paper P is recovered by an intermediate transfer belt cleaner 33.

Next, specifications of principal members and principal electrical specifications will be described.

Photosensitive drum 12: Organic photosensitive body with diameter approx. 30.0 mm Charging potential V0=−500 V (background portion potential)

Post-exposure potential VL=−200 V (image portion potential)

Processing speed: 104 mm/s

Developing system: Dry process two-component development system

Contact charger 13: Charging roller, formed of semiconductive roller DC+AC contact charging system IAC=0.7 mA (AC component current value)

Frequency=614 Hz (voltage waveform of AC component)

VDC=−520 V (DC component voltage value)

Exposure apparatus 14: Laser wavelength=780 nm

Developing roller 18: Diameter=16.0 mm

Rotation speed=208 mm/s

Rotation direction: Opposite to the direction of rotation of the photosensitive drum 12

Developing bias:

VDC=−400 V (DC component voltage value)

Vpp=1.5 kV (AC component voltage value (peak-to-peak))

Frequency=6 kHz (voltage waveform of AC component)

Development gap (gap between photosensitive drum 12 and developing roller 18): approx. 0.3 mm Intermediate transfer belt 30: Polyimide manufactured Primary transfer roller 16: Transfer bias +500 V to +1000 V, 10 μA Secondary transfer roller 36: Transfer bias +1600 V Next, a residue toner charger 200 will be described.

Figure 3:
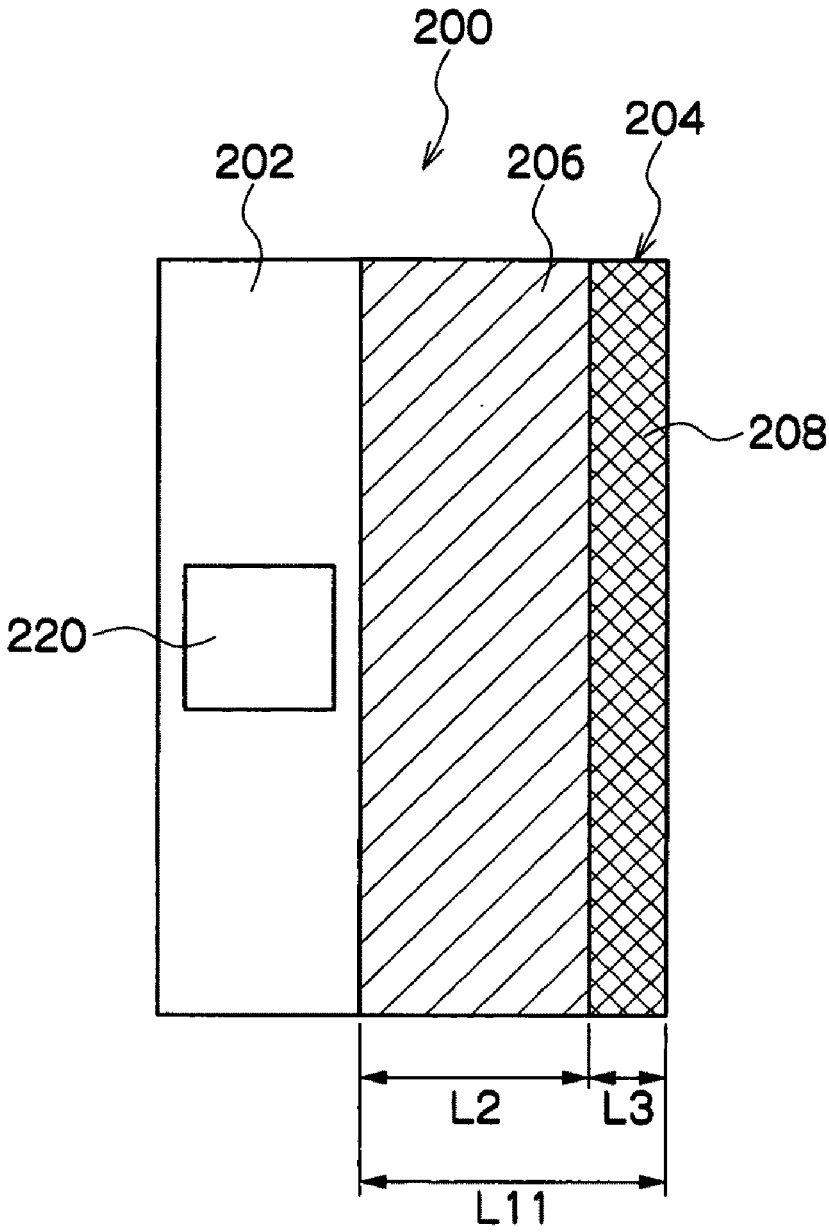
FIG. 3 is a diagram showing a residue toner charger.

As shown in FIG. 3, at the residue toner charger 200, a plate-form charging portion 204 is stuck onto a conductive support 202 with a cuboid form, which is formed of a metal or the like. At the charging portion 204, a nonwoven fabric 208 with thickness L3, which features suitable conductivity, is stuck onto a conductive urethane sponge 206, with thickness L2 and resilience. Thus, the fixed-type residue toner charger 200 is constituted, the nonwoven fabric 208 of which presses against the photosensitive drum 12 as shown in FIG. 4.

Herein, at the charging portion 204 prior to pressing against the photosensitive drum 12, as shown in FIG. 3:

the thickness L2 of the conductive urethane sponge 206 is approx. 3.0 mm, the thickness L3 of the nonwoven fabric 208 is approx. 500 μm (0.5 mm), and a total thickness L11 (L2+L3) of the charging portion 204 is approx. 3.5 mm.

Figure 4:
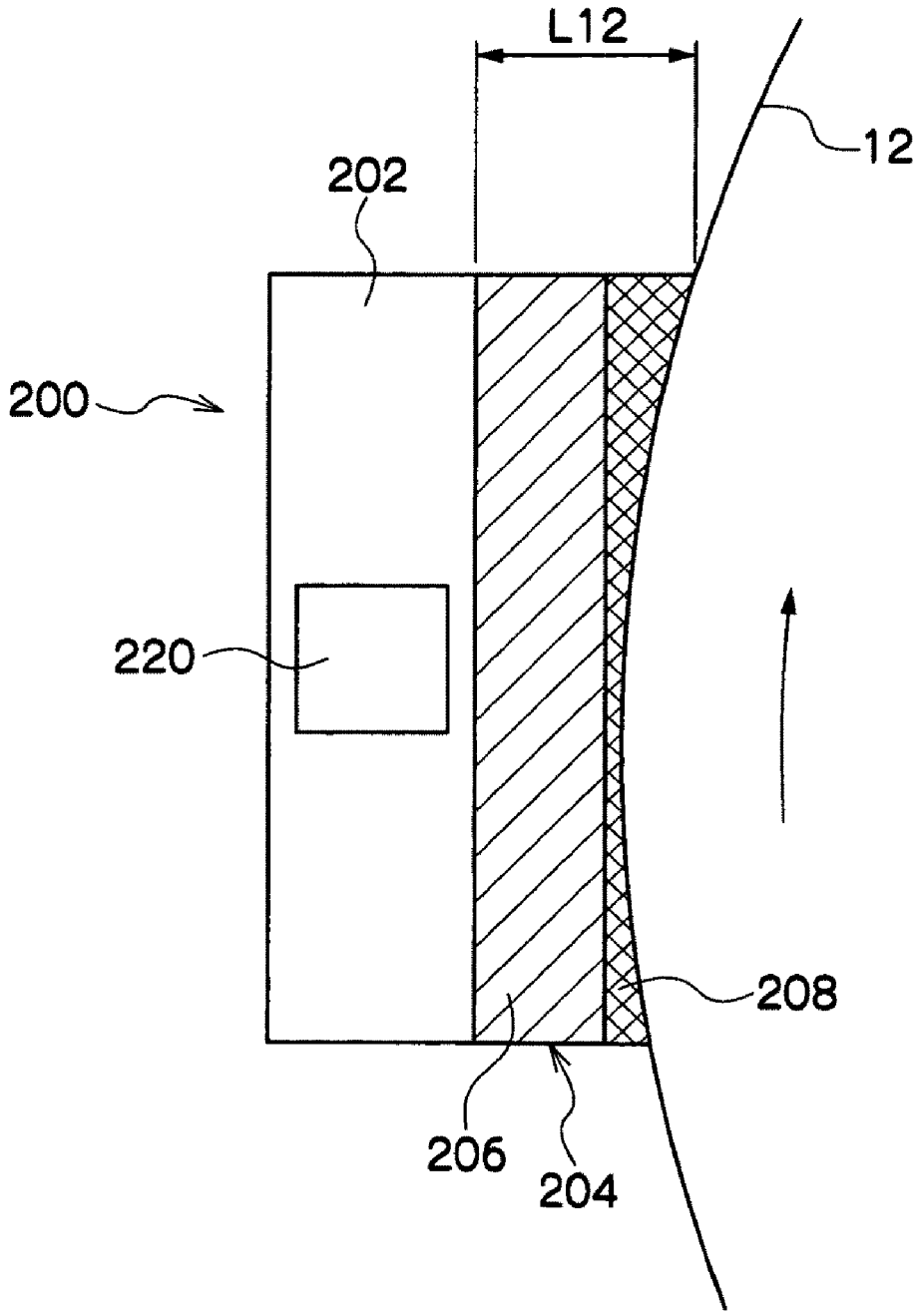
FIG. 4 is a view of a state in which the residue toner charger of FIG. 3 is pressed against the photosensitive drum.

Further, as shown in FIG. 4, a total thickness L12 of the charging portion 204 after being pressed against the photosensitive drum 12 is approx. 3.0 mm, and a bite amount is approx. 0.5 mm.

Now, nonwoven fabrics are, literally, fabrics which are not woven, being sheets in which fibers are bonded together by various methods. Fabrication methods of nonwoven fabrics include dry-process nonwoven fabrics, spunbonded fabrics, wet-process nonwoven fabrics and so forth.

For the nonwoven fabric 208 of the present embodiment, a dry-process nonwoven fabric is used. Specifically, fibers with fiber lengths of the order of centimeters are arranged into a thin sheet by a carding machine or an aerodynamic machine, and a number of sheets are superposingly formed in accordance with requirements. Bonding is performed by entangling the fibers with high-pressure fine water jets (spunlace).

For the fibers used in the nonwoven fabric 208 of the present invention, polypyyrole resin is coated onto an insulative nylon-polyester mixed fiber to provide conductivity. A fiber diameter Ø is 6.0 μm to 7.0 μm.

Figure 5:
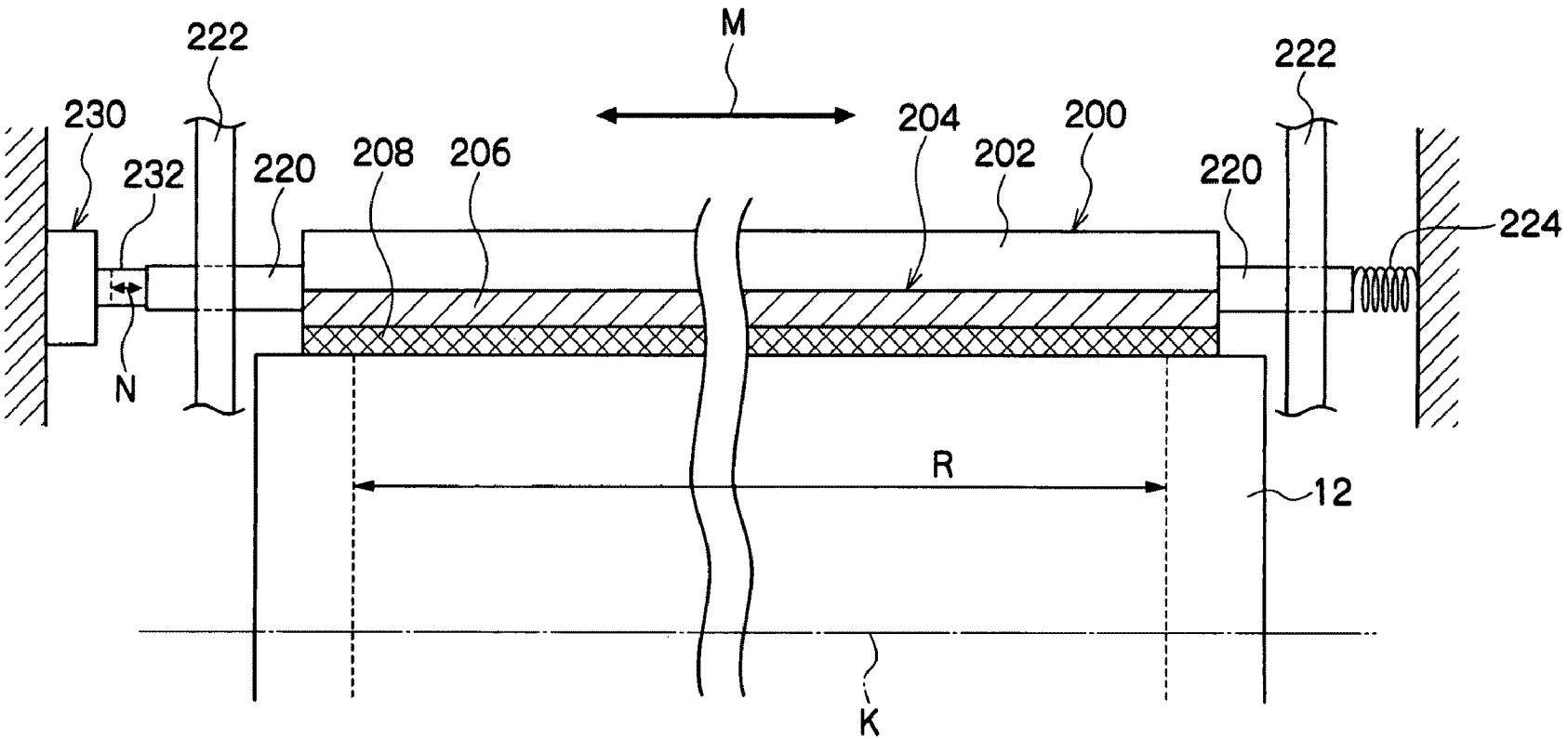
FIG. 5 is a view in which the state in which the residue toner charger is pressed against the photosensitive drum is seen from above.

As shown in FIG. 5, a long-direction width of the residue toner charger 200 is broader than an image formation width R in a rotation axis K direction of the photosensitive drum 12.

At each of two long direction ends of the support 202 of the residue toner charger 200, shafts 220 with substantially cuboid forms protrude in the same direction as the rotation axis K of the photosensitive drum 12 (i.e., the shafts 220 and the rotation axis K are parallel). The shafts 220 are inserted into cuboid-form holes of support portions 222. An end portion of one of the shafts 220 is pushed toward the other end thereof by a spring 224. A movable rod 232 of a solenoid 230 abuts against an end portion of the other of the shafts 220. This movable rod 232 can be moved in the direction of the rotation axis K of the photosensitive drum 12 (refer to arrow N in FIG. 5). As a result, the nonwoven fabric 208 of the residue toner charger 200 slides (oscillates) in the direction of the rotation axis K along the surface of the photosensitive drum 12 (refer to arrow M in FIG. 5). Even with this sliding, the nonwoven fabric 208 must press over the whole of the image formation width R of the photosensitive drum 12. Rather than the solenoid 230, a fixable structure is possible which is displaced to arbitrary positions in the rotation axis K direction by, for example, a cam or the like.

A voltage of −850 V is applied to the support 202 of the residue toner charger 200. Hence, the nonwoven fabric 208 is applied with the −850 V as a residual toner charging voltage. Thus, a potential difference is generated with respect to the charging potential of the photosensitive drum 12.

Next, operations of the present embodiment will be described.

As shown in FIGS. 1 and 2, transfer residue toner on the photosensitive drum 12 (transfer residue toner which has not been transferred to the intermediate transfer belt 30) adheres to the nonwoven fabric 208 of the residue toner charger 200 and is temporarily retained, is then charged to the normal polarity (−polarity) by the potential difference between the nonwoven fabric 208 of the residue toner charger 200 and the photosensitive drum 12, and adheres to the photosensitive drum 12. Hence, the transfer residue toner is made uniform and a transfer history is erased.

The transfer residue toner which has been set to the normal polarity (in the present embodiment, −polarity) is brought to the contact charger 13. At the contact charger 13, a charging bias VDC=−520 V is applied. Hence, because a repulsion force acts between the transfer residue toner at the normal polarity (−polarity) and the contact charger 13, the normal polarity transfer residue toner slides past the contact charger 13.

The normal polarity (−polarity) transfer residue toner which has slid past the contact charger 13 is brought to a region which faces the developing roller 18 of the developing apparatus 15 (i.e., a development portion). Because development bias setting conditions of the developing roller 18 of the developing apparatus 15 are optimized, the transfer residue toner is recovered at the developing apparatus 15 (cleaning) simultaneously with the development. Here, in order to raise a recovering efficiency of the transfer residue toner, the developing roller 18 rotates in a direction counter to the photosensitive drum 12.

Now, during charging at the contact charger 13, discharge products (active materials which are generated at times of discharges, such as ozone, nitrogen oxides and the like, and reaction products such as so forth) are generated. In particular, in an AC+DC contact charging system in which DC is superposed with AC, as in the present embodiment, discharge products are generated in large amounts. The discharge products adhere to the surface of the photosensitive drum 12 and, particularly in high temperatures and high humidities, lower electrical resistance of the surface of the photosensitive drum 12. As a result, latent images are disrupted, which leads to "image running" ("deletion"). Particularly in a system which, rather than providing a cleaning blade as a cleaning portion, performs development and recovering (cleaning) simultaneously with the developing apparatus 15, as in the present embodiment, because it is not possible to remove such discharge products on the photosensitive drum 12 with a cleaning blade, the influence is more significant.

However, in the image formation apparatus 100 of the present embodiment, the transfer residue toner is adhered to the nonwoven fabric 208 of the residue toner charger 200 and temporarily retained, and the discharge products are excellently removed by the transfer residue toner in association with rotation of the photosensitive drum 12. Therefore, problems caused by adherence of discharge products, for example, image running (deletion), are prevented.

The photosensitive drum 12 is also charged by the voltage that is applied to the nonwoven fabric 208, which is for charging the transfer residue toner to the normal polarity (−polarity). Because the face of the nonwoven fabric 208 abuts uniformly against the photosensitive drum 12, there is less unevenness of charging. Accordingly, charging variations subsequent to the contact charger 13 are very small. Consequently, density variations in images of halftones and the like do not occur, and excellent images are provided. Moreover, because charging variations are eliminated, there is no need to raise charging capabilities of the contact charger 13 more than is necessary. Thus, because it is not necessary to raise the voltage applied at the contact charger 13 any more than necessary, the generation of discharge products is suppressed (as will be described in more detail later).

With the image formation apparatus 100 of the present embodiment, even in continuous printing of 50,000 sheets of A3-size recording paper P, image failures due to toner filming, in which toner components thinly adhere to a broad range of the photosensitive drum 12, image running (deletion) due to adherence of discharge products, charging problems due to adherence of transfer residue toner to the contact charger 13, problems with recovering of transfer residue toner at the developing apparatus 15, and suchlike do not occur.

A reason for this is thought to be as follows. In comparison with, for example, the conductive fixed brush 302 which is conventionally used (see FIG. 10) the nonwoven fabric 208 has narrower fiber diameters and higher fiber densities. Therefore, the transfer residue toner is more densely, and in larger amounts, retained at the nonwoven fabric 208 (i.e., a toner retention capacity for retaining the transfer residue toner is higher). Consequently, it is thought, a residue toner-charging capacity for re-charging the transfer residue toner to the normal polarity is higher, and a discharge product removal capacity for eliminating the discharge products is higher.

Figure 10:
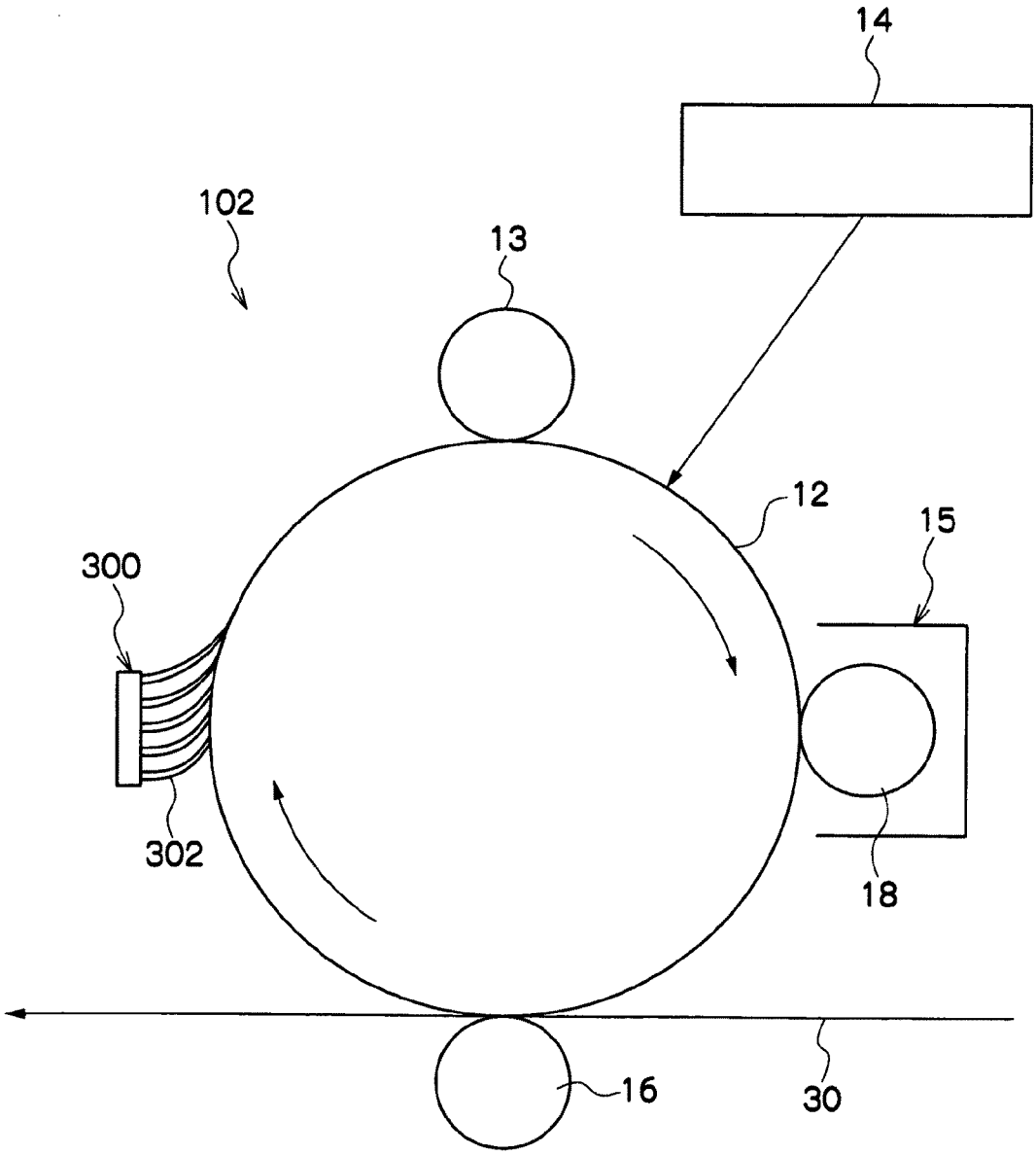
FIG.10 RELATED ART
FIG. 10 is a diagram showing an image-forming unit of a conventional image formation apparatus, which is equipped with a residue toner charger that uses a fixed brush.

Furthermore, with the conventional fixed brush 302 as shown in FIG. 10, distal ends of the brush abut against the photosensitive drum 12, and a contact pressure is large. As a result, the photosensitive drum 12 is susceptible to scratching. In contrast, because the face of the nonwoven fabric 208 as shown in FIG. 4 uniformly abuts against the photosensitive drum 12, with the toner interposed therebetween, a contact pressure is small. Therefore, the photosensitive drum 12 is less likely to be scratched.

Further, as has been described with FIG. 5, because the nonwoven fabric 208 of the residue toner charger 200 slides in the rotation axis K direction along the surface of the photosensitive drum 12, locations at which transfer residue toner is retained can be dispersed. As a result, residue toner-charging capability and discharge product removal characteristics are made uniform with respect to the rotation axis K direction.

No transfer residue toner is retained at the nonwoven fabric 208 in an initial state, and discharge product removal characteristics are low. Accordingly, it is possible to preparatorily retain toner at the nonwoven fabric 208 beforehand, to raise the discharge product removal characteristics from startup.

Now, the table of FIG. 6 shows a relationship between the fiber diameter Ø of the nonwoven fabric 208 and images after the aforementioned continuous printing of 50,000 sheets. From this table, it is seen that the fiber diameter Ø may suitably be at least 0.5 μm and at most 25.0 μm, and may more suitably be at least 1.0 μm and at most 20.0 μm.

A reason for this is thought to be that 1.0 μm≦Ø≦20.0 μm are fiber diameters at which transfer residue toner retention capabilities are particularly high.

Thus, because the nonwoven fabric 208 at the residue toner charger 200 is used, excellent image formation is performed at low cost with efficient use of space over a long period (even if printing is performed on large numbers of recording papers P).

Anyway, the present invention is not limited to the embodiment described above.

For example, only conductive fibers with the same diameters are used in the above embodiment, but this is not a limitation. It is also possible to further raise residue toner retention capability by using a fabric in which two types of fibers (or three or more types of fibers), such as, for example, non-conductive 1.0 μm superfine microfibers and conductive fibers, are entangled.

Further, as an example, in the above embodiment, polypyrrole resin is coated onto the insulative fibers to provide conductivity to the nonwoven fabric 208, but it is also possible to provide conductivity by, for example, coating other conductive resins. Alternatively, conductivity may be provided by utilizing conductive fibers which include carbon black or the like. Currently, fiber diameters of conductive fibers which are narrow are generally at 10.0 to 15.0 μm. Accordingly, provision of conductivity is simple, but fiber diameters which can be selected are tightly limited. In contrast, with a method in which a conductive resin is coated to provide conductivity, as in the above embodiment, a range of fiber diameters which can be selected is broader. However, although the selection range of conductive fibers is narrow, characteristics can be improved by combining microscopic non-conductive fibers therewith, as mentioned above.

Thus, various nonwoven fabrics may be selected in accordance with the overall image formation apparatus cost, nonwoven fabric lifetime, toner filming characteristics, discharge product removal characteristics, residue toner charging capability and the like. That is, the use of nonwoven fabrics has an advantage in that a wide range of designs (selections) is possible.

Figure 9:
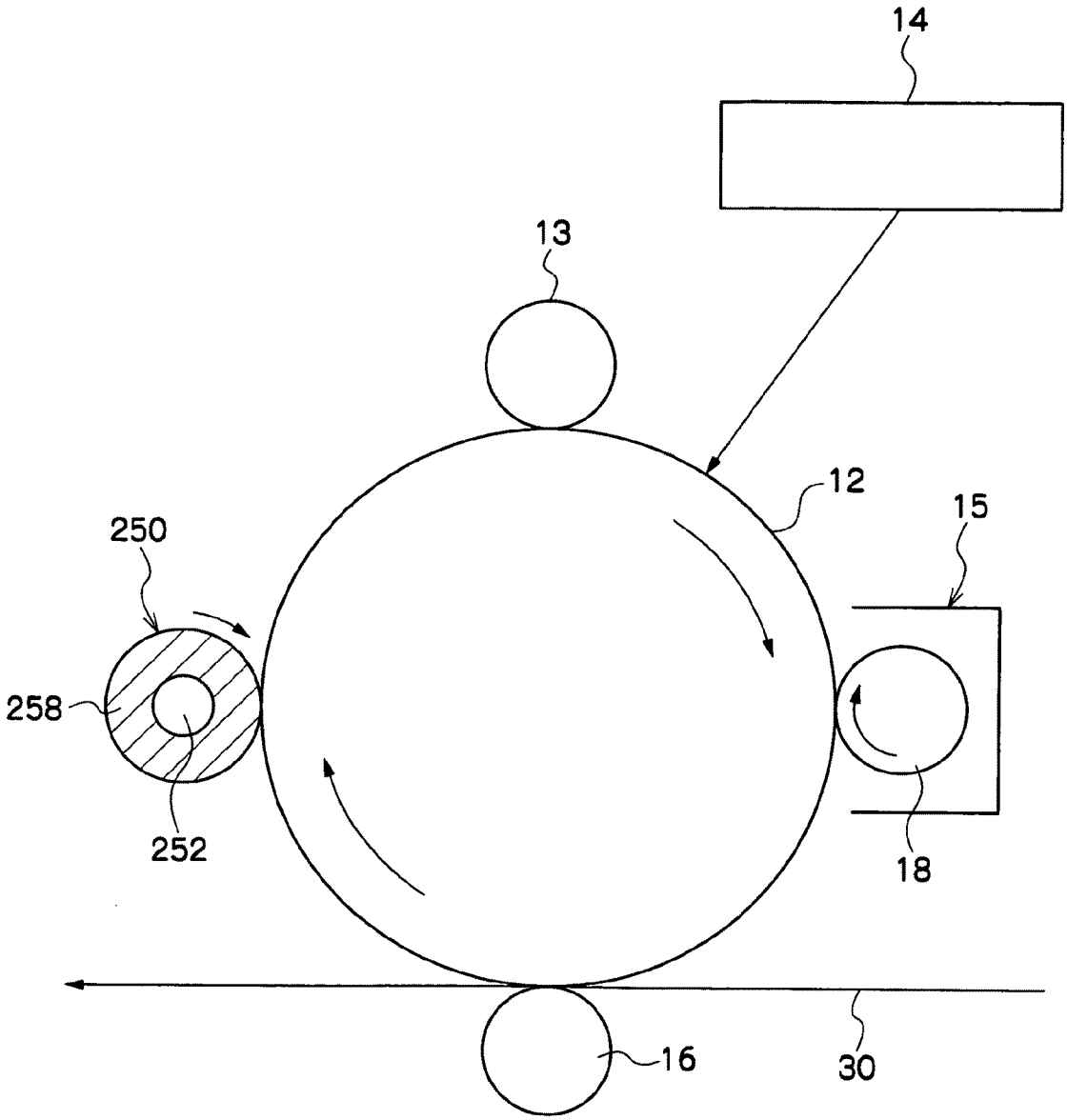
FIG. 9 is a diagram showing a rotating-type residue toner charger.

Further, instead of the fixed-type residue toner charger 200 as in the present embodiment (see FIG. 2), for example, a rotating-type residue toner charger 250 is also possible, which is equipped with a nonwoven fabric roller 258 which rotates about a rotating shaft 252, as shown in FIG. 9.

Further, as an example, regarding charging of the photosensitive drum 12, an AC+DC contact charging system superposing DC with AC is used, but a DC contact charging system which applies DC alone is also possible. With a DC contact charging system, there is little generation of discharge products, but charging characteristics are poorer. However, due to voltage being applied to the nonwoven fabric 208 as, described above, for charging the transfer residue toner to the normal polarity (−polarity), charging variations are also small at the photosensitive drum 12 at the time of charging. Thus, excellent charging is possible even with a DC contact charging system.

Next, for a conventional image formation apparatus 102 shown in FIG. 10, which is equipped with the fixed brush 302 at the residue toner charger 300, and the image formation apparatus 100 shown in FIG. 2, which is equipped with the nonwoven fabric 208 at the residue toner charger 200, which is to say, for the fixed brush 302 and the nonwoven fabric 208, test results comparing differences between the discharge product removal capabilities and residue toner-charging capabilities thereof will be described.

Here, the nonwoven fabric 208 has the structure described for the above embodiment. The fixed brush 302 uses conductive nylon with a fiber diameter of 15.0 μm, a density of 430 kfibers/inch$^2$, and a pile height of 5.0 mm. Bite amounts in both cases are 0.5 mm, and applied voltages (residue toner-charging voltages) are −850 V in both cases.

—Test 1 (Discharge Product Removal Capability Test)—

In a high temperature and high humidity (28° C./85%), after continuous printing of 5,000 sheets of A3-size recording paper P, a contact angle of water on the photosensitive drum 12 (which will be described in more detail later) is measured, and a relationship between a current value IAC of the AC component that is applied to the contact charger 13 and the contact angle is tested. Image running (deletion) will occur if the contact angle is 80° or less, and more discharge products are generated when the current value IAC is larger.

A charging commencement current is an IAC of 0.6 mA. When this charging commencement current is exceeded, a desired charging potential V0of the photosensitive drum 12 can be obtained. However, in consideration of variations in the charging commencement current, deterioration of the contact charger 13 and the like, in high temperatures and high humidities, a margin of the order of about +10% with respect to this charging commencement current is desirable. That is, an IAC of around 0.66 mA is desirable.

Figure 7:
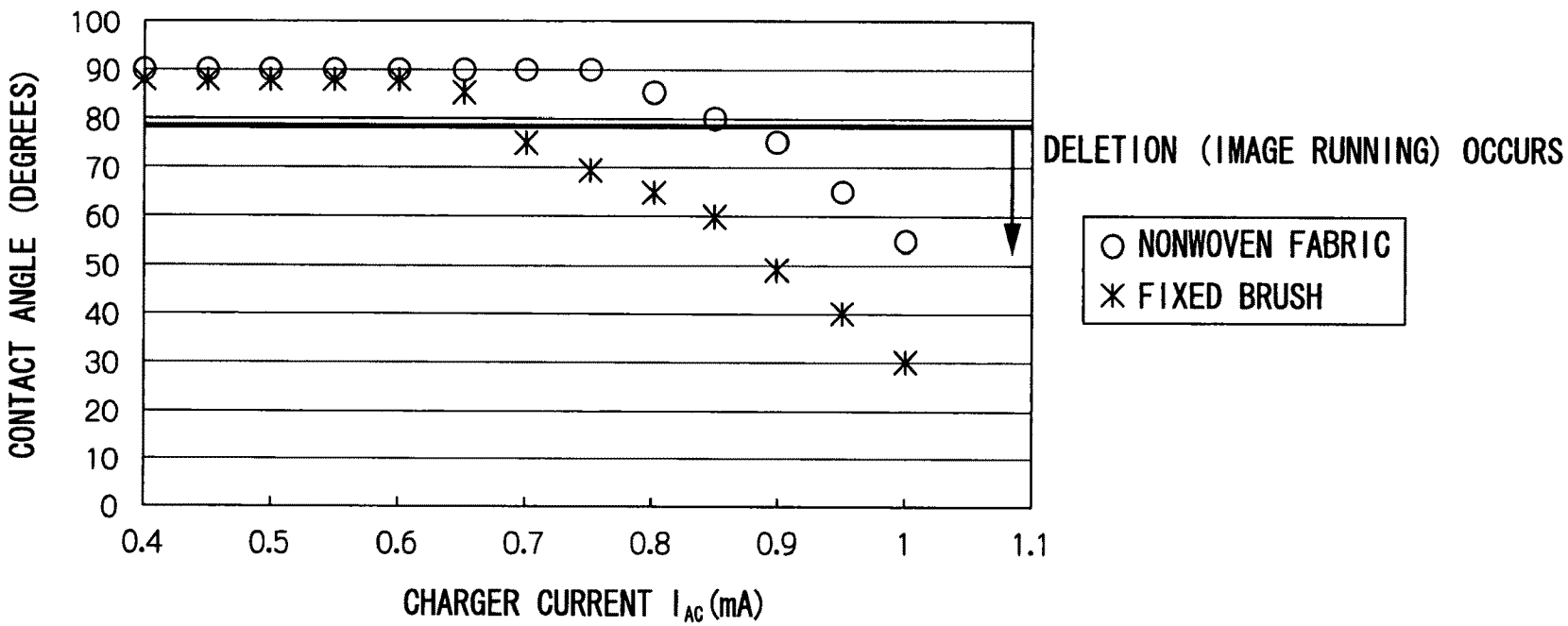
FIG. 7 is a graph showing results of a test in which a contact angle of water with a photosensitive drum is measured after printing of 5,000 sheets, and a difference between discharge product removal capabilities of a nonwoven fabric and a fixed brush is tested.

FIG. 7 is a graph showing test results. According to this graph, with the fixed brush 302, the contact angle falls below 80°, at which image running (deletion) occurs, when IAC is 0.7 mA and above. In contrast, with the nonwoven fabric 208, the contact angle falls below 80°, at which image running (deletion) occurs, when IAC is 0.9 mA and above.

Thus, it can be seen that, in comparison with the fixed brush 302, the nonwoven fabric 208 has much higher discharge product removal capabilities.

As a reason for this, it is thought that because, as mentioned earlier, the nonwoven fabric 208 has narrower fiber diameters and higher densities, greater amounts of transfer residue toner are more densely retained, and removal characteristics for removing discharge products which have adhered to the photosensitive drum 12 are higher.

Now, when transfer residue toner is retained in large amounts and rubbed over the photosensitive drum 12, the transfer residue toner is melted by friction with the photosensitive drum 12. Thus, toner filming, in which toner components thinly adhere to the surface of the photosensitive drum 12 over a wide range, and additive filming, in which external additives of the toner firmly adhere to the surface of the photosensitive drum 12, are likely to occur. However, at least with a bite amount of the nonwoven fabric 208 being 1.0 mm or less, it is confirmed that such filming will not occur. Therefore, in the above test and the present embodiment, the bite amount is set to 0.5 mm. For the fixed brush 302 too, it is confirmed that toner filming does not occur with a bite amount of 1.0 mm or less. Accordingly, the bite amount thereof is similarly set to 0.5 mm in the above test.

Figure 11:
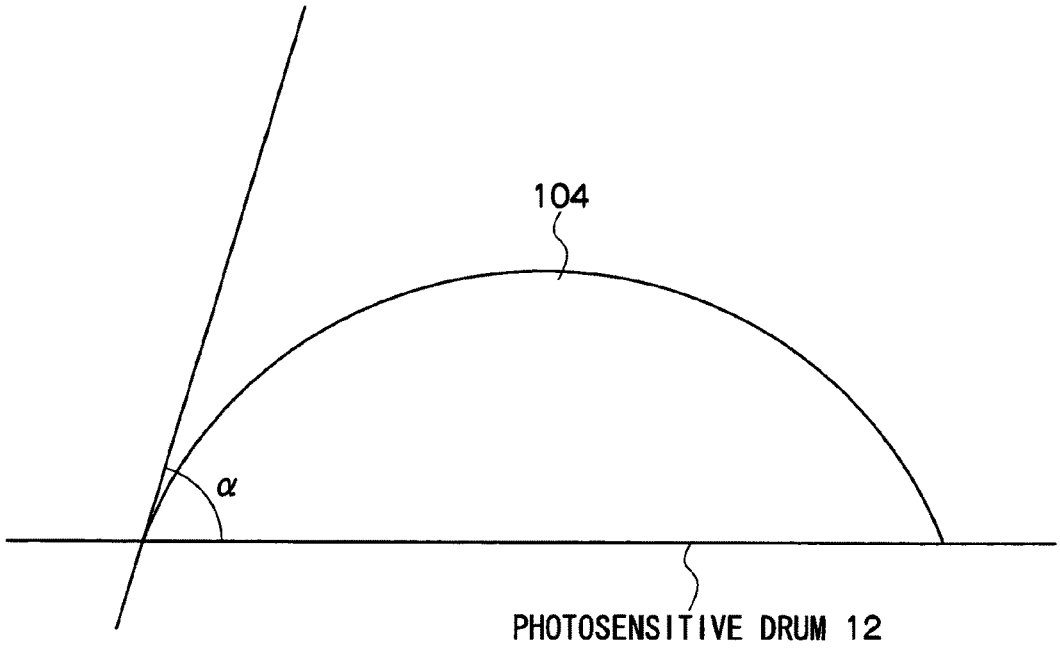
FIG. 11 is a diagram for explaining contact angles.

Contact angles are used for evaluating how liquids and solids wet or do not wet, i.e., wetting characteristics. Specifically, as shown in FIG. 11, a liquid droplet 104 (water in the above test) is applied to a solid sample (in the above test, the photosensitive drum 12 subsequent to 5,000 prints), the liquid droplet 104 is observed from sideways, and the contact angle is an angle of rise of this droplet, that is, a contact angle $\alpha$ which is formed between two lines, the solid surface (the horizontal line) and a tangential line at an end of the liquid droplet. Larger contact angles $\alpha$ represent higher water repellent. In test 1, water repellent falls (becoming hydrophilic) in accordance with an increase in discharge products at the surface of the photosensitive drum 12. Thus, adherence amounts of discharge products are quantitively measured by measuring the contact angle $\alpha$.

—Test 2 (Residue Toner-Charging Capability Test)—

After continuous printing of 100 sheets of A3-size recording paper P, a relationship between a toner amount (weight) per unit area of reverse polarity toner (at +15 μC/g and above) of the transfer residue toner that has entered into the fixed brush 302 or the nonwoven fabric 208 and a toner amount (weight) per unit area that has adhered to the contact charger 13 is investigated. If 0.2 g/m$^2$ or more of transfer residue toner (reverse polarity toner) adheres to the contact charger 13, image defects will occur as a result of charging failures.

Here, rather than the aforementioned −850 V, −1.0 kV is applied to the fixed brush 302 and the nonwoven fabric 208. Moreover, in the present investigation, the transfer voltage is raised relative to specifications (−700 V), such that large amounts of reverse polarity toner are generated. Therefore, in actual specifications, toner amounts (weights) per unit area will be lower than 0.2 g/m$^2$ or less.

Figure 8:
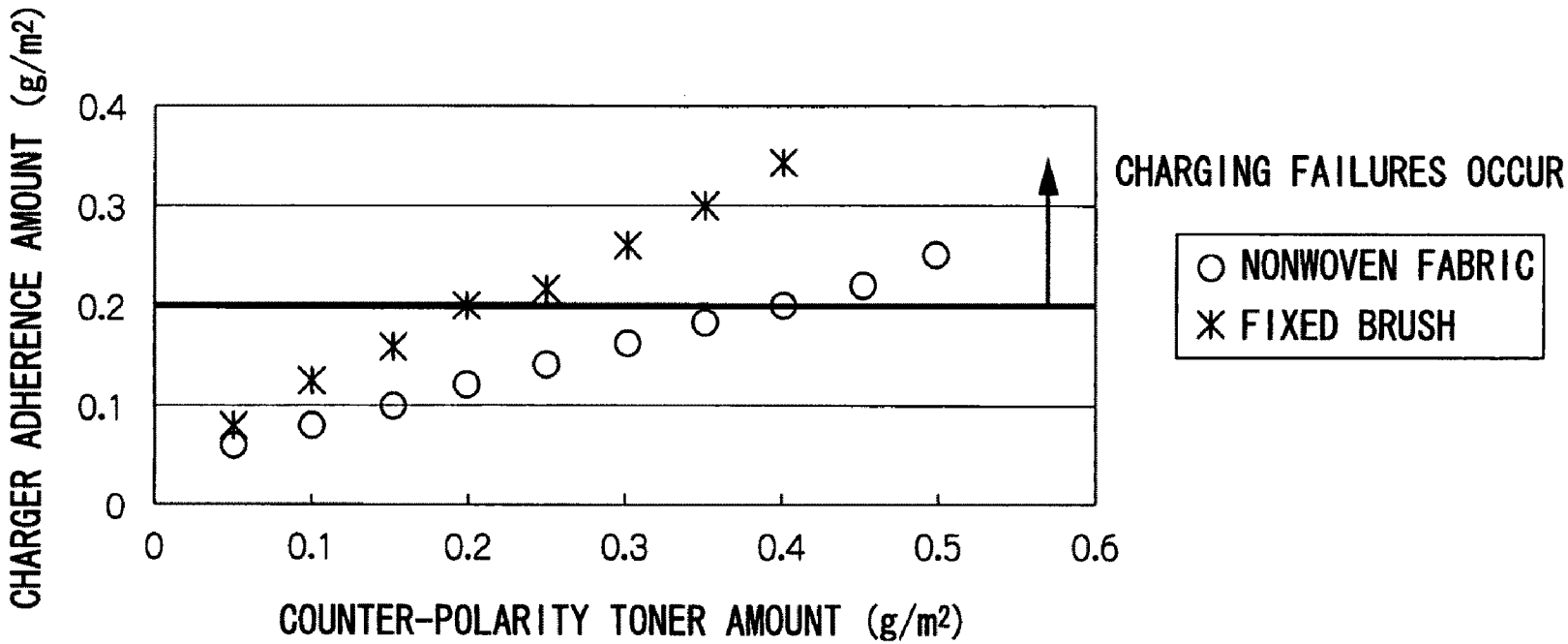
FIG. 8 is a graph showing results of a test in which adherence amounts of toner which has adhered to a charger after printing of 100 sheets is measured, and a difference between residue toner-charging capabilities of a nonwoven fabric and a fixed brush is tested.

FIG. 8 is a graph showing experimental results. According to this graph, for the fixed brush 302, a toner amount adhering to the contact charger 13 is 0.2 g/m$^2$ or more, leading to charging malfunctions, with an entry amount of 0.25 g/m$^2$ or more. In contrast, for the nonwoven fabric 208, a toner amount adhering to the contact charger 13 is 0.2 g/m$^2$ or more, leading to charging failures, with an entry amount of 0.45 μm$^2$ or more.

That is, it can be seen that, in comparison with the fixed brush 302, the nonwoven fabric 208 has much higher residue toner-charging capabilities.

A reason for this is thought to be as follows. Even when a large amount of reverse polarity toner has entered into the nonwoven fabric 208, a toner retention capacity of the nonwoven fabric 208 is high. Therefore, nearly all of the reverse polarity toner is temporarily retained and re-charged to the normal polarity. In contrast, it is thought that, because the fixed brush 302 has a lower toner retention capacity than the nonwoven fabric 208, large amounts of residual transfer toner (reverse polarity toner) enter into the contact charger 13 still at the reverse polarity, not having been re-charged to the normal polarity.

Next, an investigation for an improvement in discharge product removal capability due to retention of toner will be described.

Even with a conventional brush, discharge product removal capability can be improved if pressure at the distal end of the brush is raised. However, when pressure at the brush distal end is raised, a CTL layer (charge transfer layer, which is not shown) at the surface of the photosensitive drum 12 is simultaneously worn away by the brush, and chaff worn away therefrom adheres to the photosensitive drum 12. The chaff acts as nuclei around which additives in the toner adhere. As this progresses, filming occurs in a raindrop pattern (a scattered spot pattern). When this raindrop-pattern (scattered spot-pattern) filming occurs, dropouts appear in images. In addition, when the brush distal end pressure of the brush is raised, scratching (damage) is also caused.

—Test 3 (Test of Improvement of Discharge Product Removal Capability by Retention of Toner)—

The fixed brush 302 shown in FIG. 10 or a rotating brush formed with a similar brush is touched against a photosensitive body, and the photosensitive drum 12 is turned approx. 4,000 times over 1 hour in a high-temperature, high-humidity environment (28° C., 85%). Thereafter, a degree of reduction of the contact angle at the photosensitive drum 12 and a state of occurrence of filming are investigated.

If the contact angle is initially 90° and falls by 10° or more (i.e., falls to 80° or less), image deletion and the like will be caused by discharge products.

The state of occurrence of filming is evaluated from images and observation with an optical microscope, and is categorized by degree into five levels: G0 level (non-occurrence);

G1 level (filming hardly occurs at all and image dropouts do not occur); G2 level (slight filming occurs and dropouts appear on a print to a slight extent); G3 level (filming occurs and dropouts appear on a print, partially in streak forms); G4 (filming occurs to a great extent and dropouts in half of a print); and G5 (severe filming occurs over substantially the whole surface and dropouts in substantially the whole of a print). Herein, a level of G1 or below can be judged to be non-problematic.

Conditions of rotating brushes are as follows.

Brush diameter: Φ10 or 12

Shaft diameter: Φ5 or Φ6

Brush fiber thickness: 2 d, 4 d or 6 d

Rotation direction: with the photosensitive drum 12 or counter thereto

Rotation speed: 0 to 104 mm/s

Conditions of fixed brushes are as follows.

Brush width: 5.0 mm

Brush length: 4, 5 or 6 mm

Brush fiber thickness: 2 d, 4 d or 6 d

By varying the above conditions, trials in which the brush distal end forces are variously altered are performed.

Figure 12:
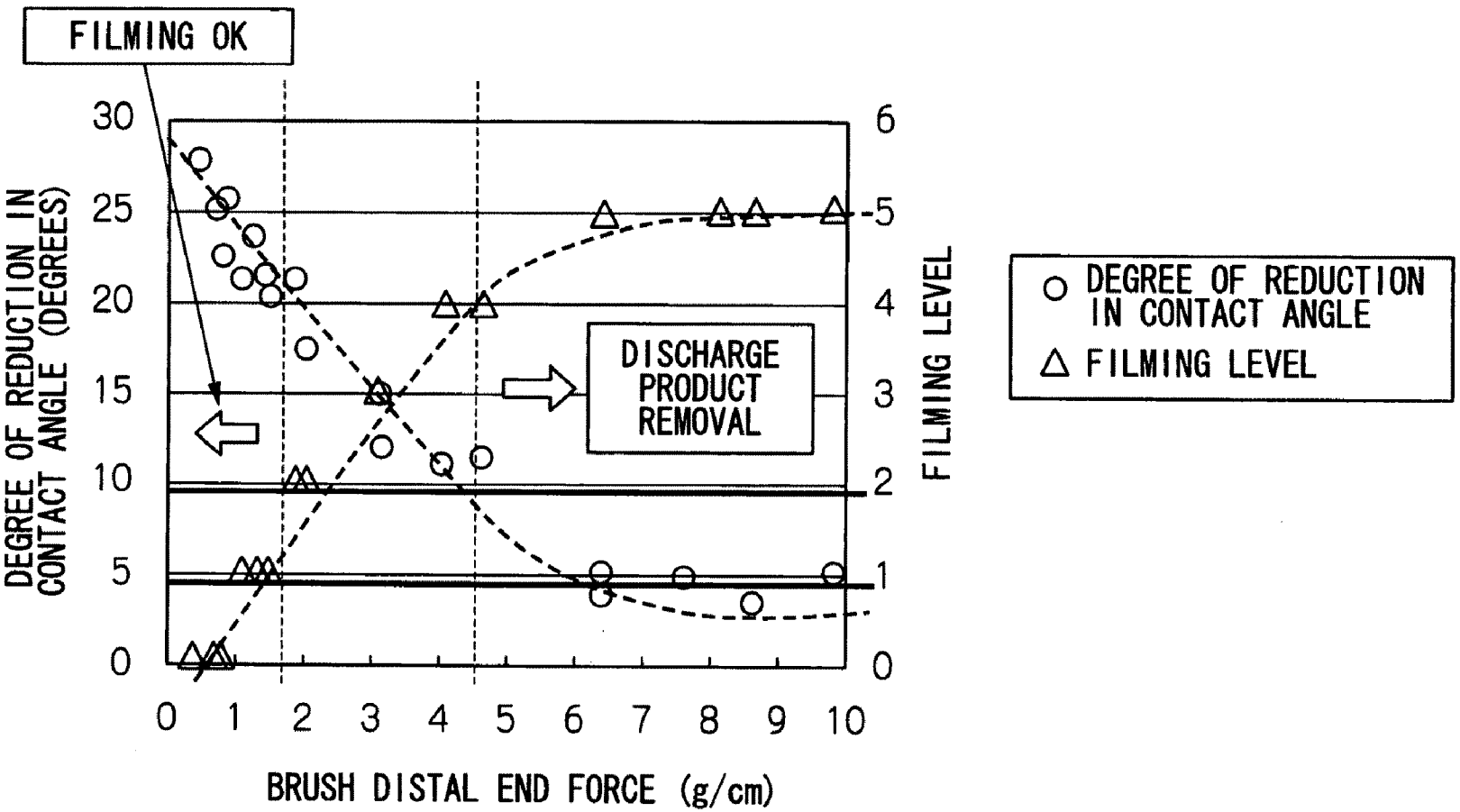
FIG. 12 is a graph showing relationships between distal end force of a brush and filming and discharge products.

The graph of FIG. 12 shows results for when no toner at all is retained at the fixed brush or rotating brush. To restrain a fall in the contact angle to 10° or less, a distal end force of about 4.5 g/cm or more is necessary. However, to keep filming to level G1 or below, about 1.6 g/cm or less is necessary. Therefore, it is not possible to achieve prevention both of image running (deletion) due to discharge products and of dropouts and filming.

Figure 13:
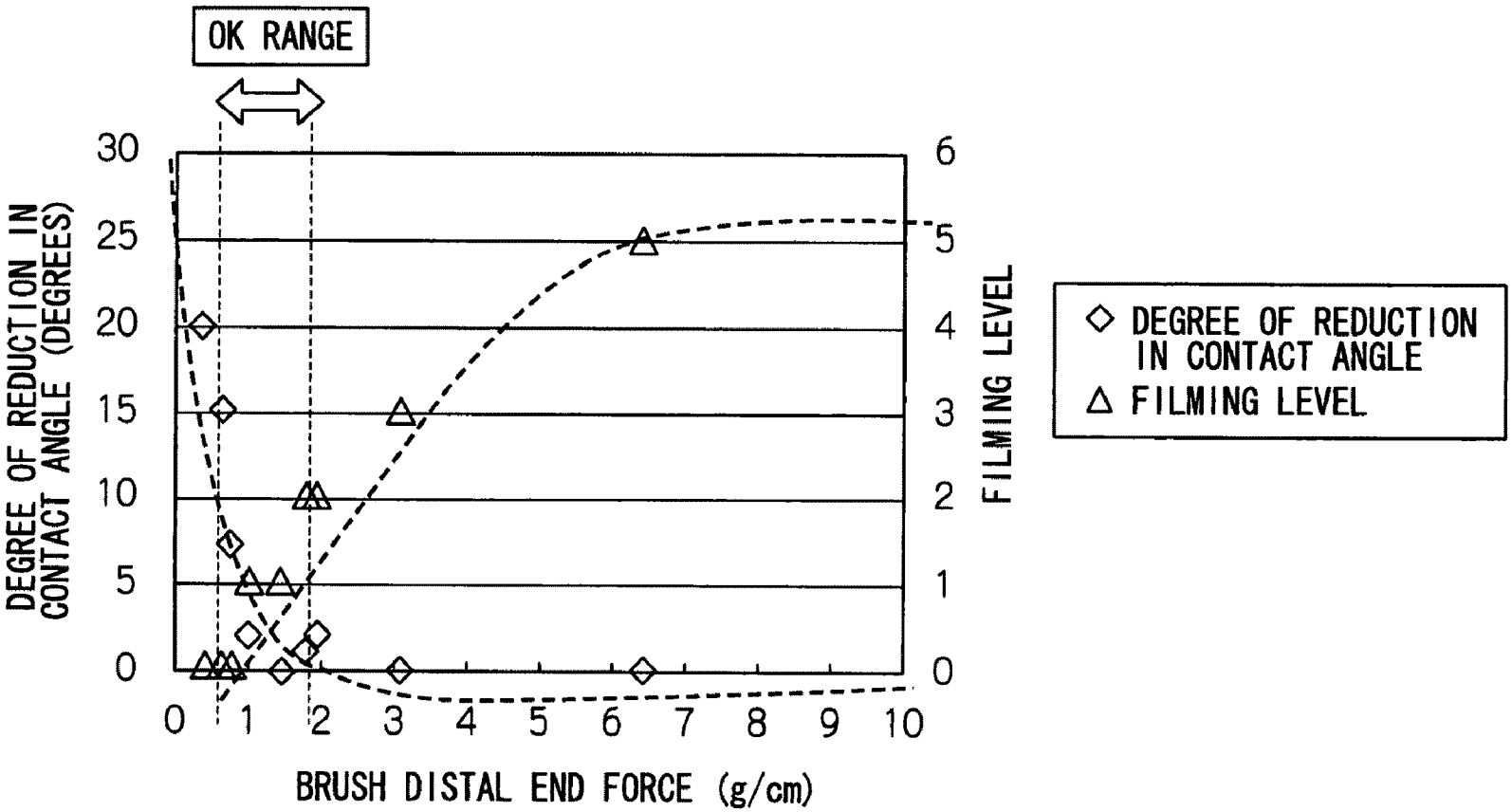
FIG. 13 is a graph showing relationships between distal end force of a brush which retains toner and filming and discharge products.

Next, trials similar to the above are performed with a substantial amount of toner being retained at the fixed brush or rotating brush. As shown in the graph of FIG. 13, with the brushes retaining toner, the contact angle can be kept to 10° or less and filming does not occur if the distal end force is between approx. 0.5 g/cm and approx. 1.8 g/cm.

Thus, it can be seen that characteristics are improved by toner being retained at the brush. However, a range in which it is possible to achieve both the removal of discharge products and the prevention of filming is very narrow at about 1.3 g/cm, and design and manufacture to set brush distal end forces in this range is extremely difficult.

Next, similar trials are performed using the nonwoven fabric 208 shown in FIG. 2.

The nonwoven fabric 208 is a fabric formed of nylon and polyester microfibers with a thickness corresponding to approx. 0.3 d (a diameter of approx. 5 μm). The thickness of the nonwoven fabric 208 is about 500 μm, which is adhered onto the urethane sponge with the thickness of about 3 mm. Here, because it is not possible to measure a distal end force as for a brush, degrees of reduction of contact angle (discharge product removal characteristics) and states of occurrence of filming are studied for bite amounts of the nonwoven fabric onto the photosensitive drum 12 (see FIGS. 3 and 4).

Figure 14:
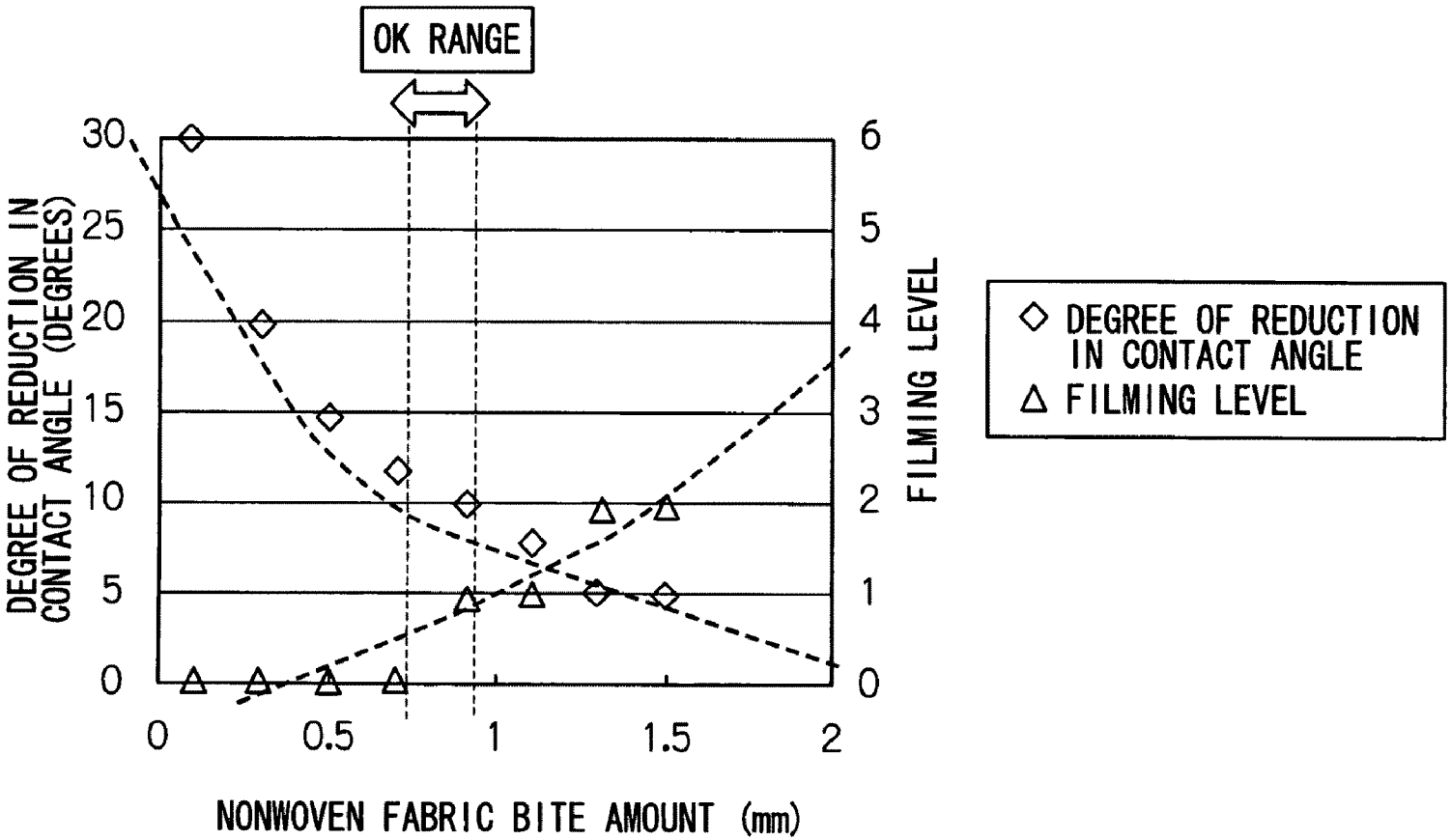
FIG. 14 is a graph showing relationships between bite amount of a nonwoven fabric and filming and discharge products.
Figure 15:
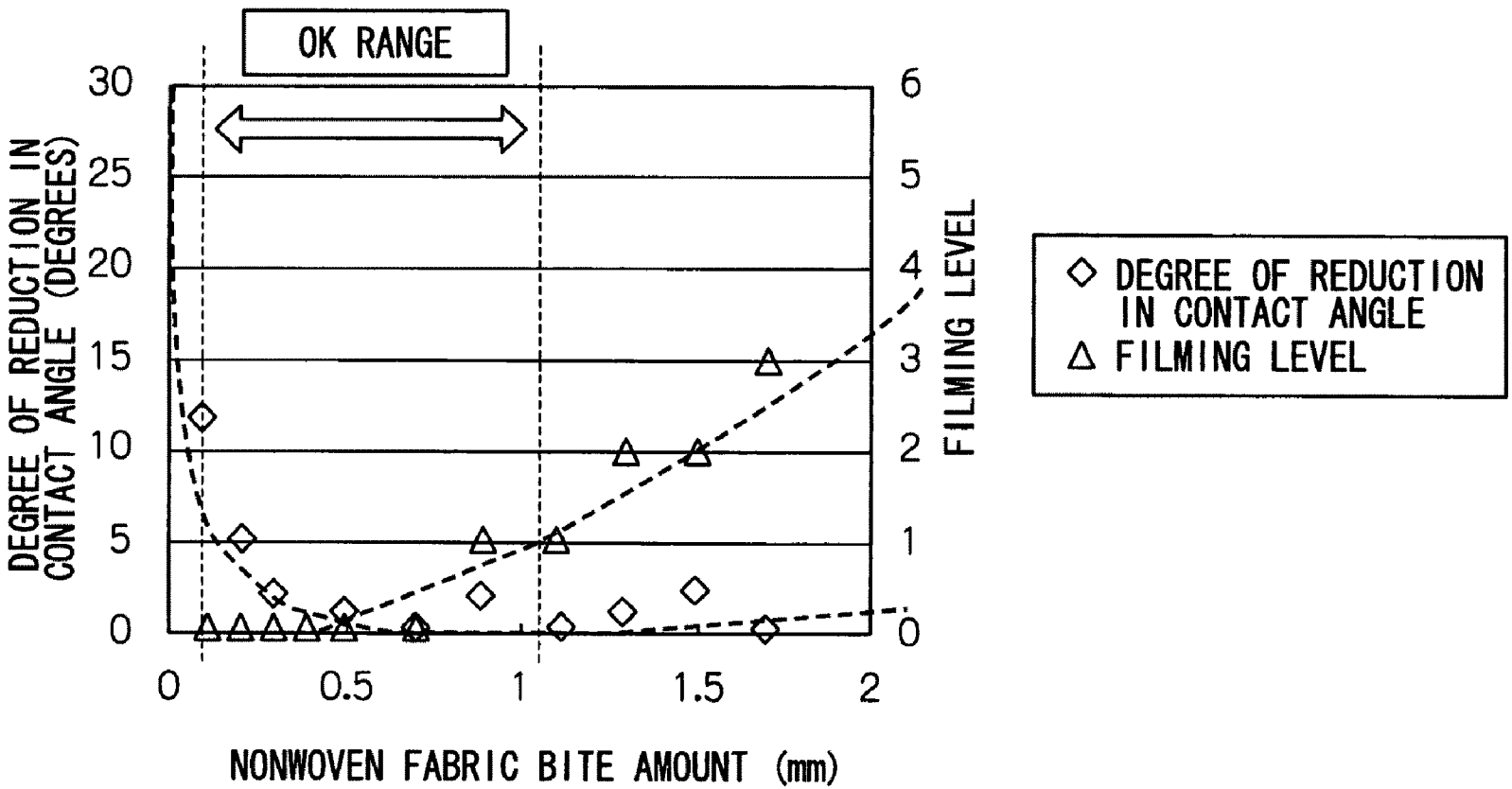
FIG. 15 is a graph showing relationships between bite amount of a nonwoven fabric which retains toner and filming and discharge products.

As shown in the graph of FIG. 14, when toner is not retained, both a fall in contact angle of less than 10° and prevention of filming are achieved with bite amounts in the range of about 0.7 to 0.9 mm. On the other hand, as shown in the graph of FIG. 15, with the nonwoven fabric 208 significantly retaining toner, the same are achieved in a range of about 0.15 to 1.1 mm. Thus, it can be seen that characteristics are greatly improved when toner is retained.

Therefore, because there is an effect of removing discharge products from the toner itself and the toner is actively retained at the nonwoven fabric, it is possible to remove discharge products with a lower abutting pressure (i.e., bite amount) than in a case in which there is no toner. Furthermore, because it is possible to remove discharge products with this low abutting force (bite amount), filming is also prevented. Further still, because the range of abutting pressures (bite amounts) which can achieve both removal of discharge products and prevention of filming is broad, design and manufacture is simple.

Next, an investigation of an effect of simultaneously charging the photosensitive drum 12 when transfer residue toner is being charged will be described.

—Test 4 (Test of Charging Unevenness)—

The nonwoven fabric is provided as a nonwoven fabric roller, as shown in FIG. 9. The nonwoven fabric has a thickness of about 500 μm and is formed of conductive nylon with a thickness corresponding to approx. 0.3 d (diameter approx. 5.0 μm). The nonwoven fabric is mounted on a conductive urethane sponge with thickness about 2.0 mm, which is provided around the shaft.

A rotating brush used for comparison has a shaft diameter of Φ5 mm, conductive nylon with thickness 2 d, and an external diameter of Φ11 mm.

Both cases are rotated in the same direction as the photosensitive drum 12 at about 0.6 times the speed of the photosensitive drum 12. An applied voltage in both cases is set to −850 V.

The contact charger 13 uses a charging roller which is formed with a semiconductor roller.

Figure 16:
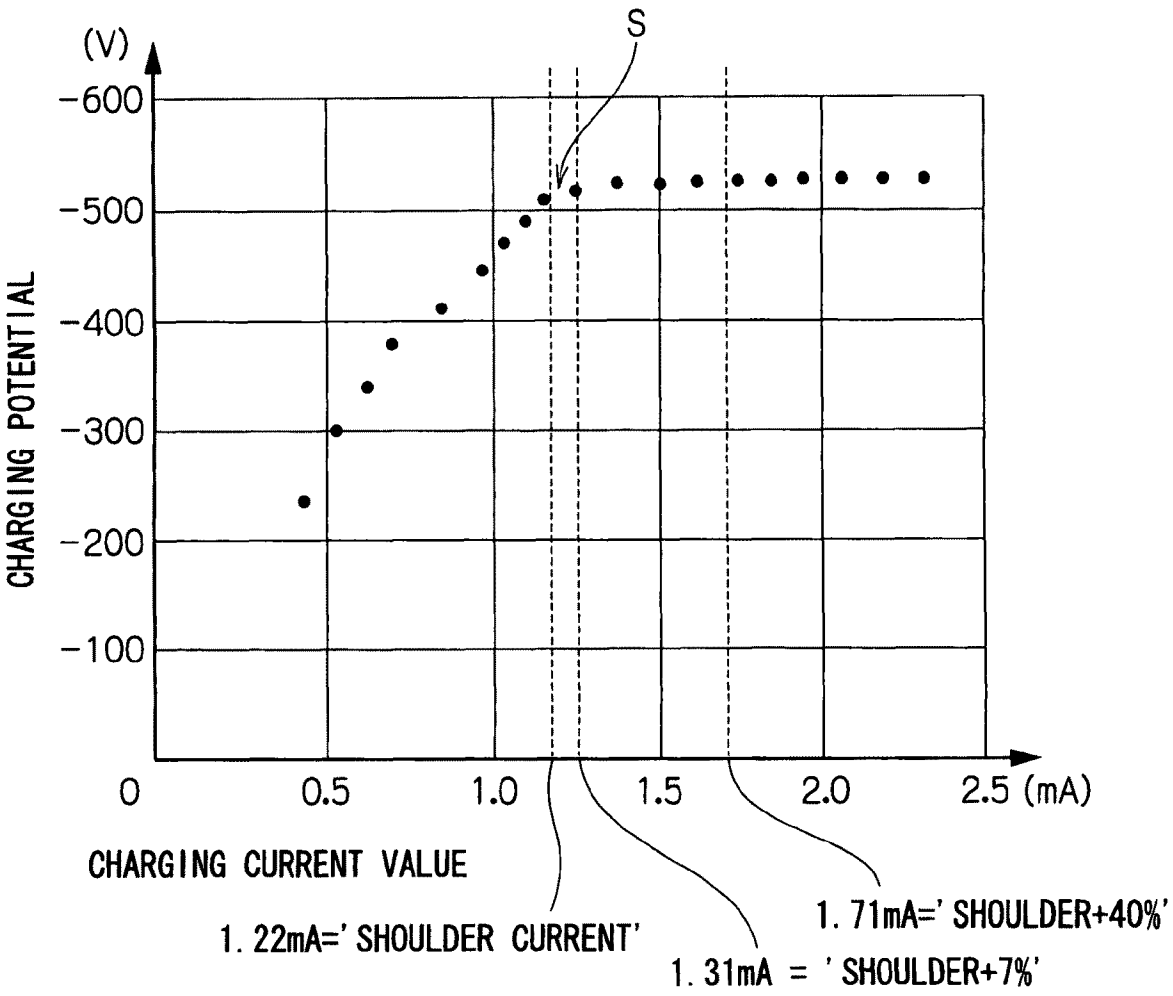
FIG. 16 is a graph showing a relationship between an AC voltage which is applied to a contact charger and a charging potential.

Now, as shown in the graph of FIG. 16, a voltage is applied to the contact charger 13 and, as the current value of an AC component increases, a charging potential of the photosensitive drum 12 rises (here, VDC (the DC component voltage value) is set at −520 V). However, when a certain current or more is applied, the charging potential saturates (saturation). A current value of a shoulder region S, which is the current value of this saturation (i.e., becoming constant), is hereafter referred to as a shoulder current. In FIG. 16, the shoulder current is 1.22 mA. Further, where "shoulder+40%" is written, this means a current value with a 40% increase over the shoulder current of 1.22 mA, that is, 1.22 mA×1.4=1.71 mA. Where "shoulder+7%" is written, this means a current value with a 7% increase over the shoulder current of 1.22 mA, that is, 1.22 mA×1.07=1.31 mA. An AC frequency of the charging roller in this test is 819 Hz, and a processing speed of the photosensitive drum is 165 mm/s.

In a high-temperature, high-humidity environment (25° C., 85%), for the above-described nonwoven fabric roller and rotating brush, the following are evaluated.

(1) A charging variation (a difference between a maximum value and a minimum value) of charging potential of the photosensitive drum 12 prior to passing the contact charger 13 (but subsequent to passing the nonwoven fabric roller or rotating brush)

(2) A charging variation (a difference between a maximum value and a minimum value) subsequent to passing the contact charger 13

(3) Density variations of halftone images (black ratio 20%)

As shown in FIGS. 17 and 18, in cases with the rotating brush, the charging variations prior to passing the charger (after passing the rotating brush) are very large, at 130 V. A cause of this is that, excepting simple variations in impressing of the brush, because distal portions of the bristles of the brush are point contacts with high pressures, a charge injection phenomenon occurs and charging potential is higher at such locations.

In contrast, in cases with the nonwoven fabric, the charging variations prior to passing the charger (after passing the nonwoven fabric) are small. at 40 V. This is because the charge injection phenomenon hardly occurs at all, because the nonwoven fabric is in surface contact at low pressure.

Further, as shown in FIG. 17, in the case of "shoulder+40%", a charging capability of the contact charger 13 is high. Hence, even though the charging variation before passing the contact charger 13 (after passing the rotating brush) is 130 Vc, the charging variation after passing the contact charger 13 is approx. 13 V. Therefore, density variations do not occur in halftone images.

On the other hand, as shown in FIG. 18, in the case of "shoulder+7%", the charging capability of the contact charger 13 is lower. Hence, in the case of the rotating brush, the charging variation after passing the contact charger 13 is larger, at 25 V. Therefore, density variations will occur in halftone images. In contrast, in the case of the nonwoven fabric, because the charging variation is initially small anyway, the charging variation after passing the contact charger 13 is approx. 12 V, and density variations do not occur in halftone images.

Thus, charging irregularities are small with the nonwoven fabric because the surface thereof abuts uniformly against the photosensitive drum. Consequently, even if the charging capability of the contact charger 13 is not set high, that is, even if a current value of an AC component that is applied to the contact charger 13 is not set high, charging irregularities subsequent to the contact charger 13 are very small. Therefore, there is no need to increase the voltage applied to the contact charger 13 beyond what is necessary, and hence the generation of discharge products is suppressed.

In the experiment described above, the nonwoven fabric roller is formed as shown in FIG. 9, but results are similar with the fixed-type nonwoven fabric shown in FIG. 3 or the like.

Anyway, as has been described with the above 'test 1' and 'test 3', it is understood that the nonwoven fabric at which toner is retained has extremely high discharge product removal capability. Thus, in the first embodiment described above, the residue toner charger 200 implements both discharge product removal and residue toner-charging adjustment.

For embodiments hereafter, structures will be described which use a nonwoven fabric at a toner retention member whose primary purpose is the removal of discharge products. Note that the residue toner charger 200 of the first embodiment is a component which combines charging adjustment of the transfer residue toner with a toner retention member (toner retention apparatus) whose primary purpose is the removal of discharge products.

First, a second embodiment will be described. Note that members that are the same as in the first embodiment are assigned the same reference numerals, and duplicative descriptions are omitted. Moreover, only the image formation unit is illustrated, and drawings of the overall image formation apparatus are not shown.

Similarly to the descriptions of the first embodiment, transfer residue toner on the photosensitive drum 12 that has not been transferred to the intermediate transfer belt 30 is below referred to as 'transfer residue toner'.

Figure 19:
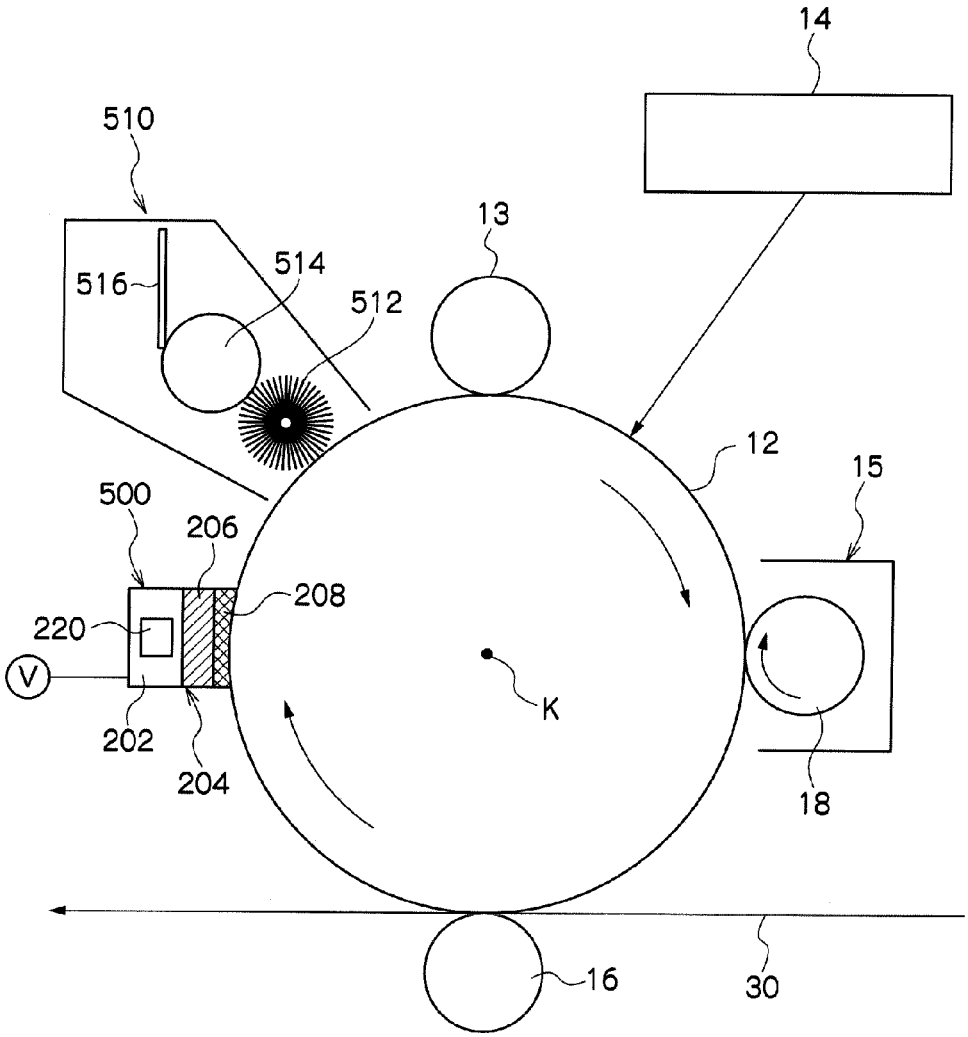
FIG. 19 is a diagram showing an image-forming unit of an image formation apparatus relating to a second embodiment of the present invention.

As shown in FIG. 19, a toner retention apparatus 500 is equipped with the nonwoven fabric 208 featuring conductivity, which abuts against the photosensitive drum 12. The toner retention apparatus 500 is provided at a downstream side relative to the primary transfer roller 16. A bias voltage which causes discharges (in the present embodiment, −850 V DC) is applied to the nonwoven fabric 208.

In addition, differently from the first embodiment, a cleaning apparatus 510 is provided between the toner retention apparatus 500 and the contact charger 13. The cleaning apparatus 510 is equipped with a conductive rotating brush 512, which abuts against the photosensitive drum 12. A recovering roller 514 featuring conductivity abuts against the rotating brush 512, and a scraper 516 abuts against the recovering roller 514.

The transfer residue toner is retained at the nonwoven fabric 208. Transfer residue toner which slides past without being retained is charge-adjusted to a normal polarity (which is negative in the present embodiment), by discharging with the bias voltage of −850 V that is applied to the nonwoven fabric 208.

The transfer residue toner which has been charge-adjusted to this normal polarity is mechanically scraped off by the rotating brush 512 and removed.

Further, DC 0 V is applied to the rotating brush 512, and thus the toner is also removed by electrically adhering to the rotating brush 512. This is because potential of the photosensitive drum 12 subsequent to passing the nonwoven fabric 208 is about −400 V and so, with the potential of the rotating brush 512 being 0 V, the transfer residue toner which has been charge-adjusted to the negative polarity (normal polarity) adheres to the rotating brush 512.

The transfer residue toner which has adhered to the rotating brush 512 and been removed is transferred to the recovering roller 514, to which a bias voltage is applied, and is then scraped off by the scraper 516 and recovered. Therefore, differently from the first embodiment, there is no need to recover the transfer residue toner at development.

Next, operations of the present embodiment will be described.

As mentioned earlier, discharge products adhere to the surface of the photosensitive drum 12 and cause problems with image deletion and dropouts in high-temperature, high-humidity environments.

Further, as described earlier, if a brush distal end pressure of the rotating brush 512 is raised, the discharge product removal capability is improved. However, the CTL layer (charge transfer layer, which is not shown) at the surface of the photosensitive drum 12 are simultaneously worn away by the rotating brush 512, and chaff therefrom adheres to the photosensitive drum 12 and acts as nuclei around which additives in the toner adhere. As this progresses, filming occurs in a raindrop pattern (a scattered spot pattern). When this raindrop-pattern (scattered spot-pattern) filming occurs, dropouts appear in images. In addition, when the brush distal end pressure of the rotating brush 512 is raised, scratching (damage) is also caused.

However, because the discharge products are removed by the toner retention apparatus 500 which is equipped with the nonwoven fabric 208 which retains toner, there is no need to raise the brush distal end pressure of the rotating brush 512 any more than is necessary. Thus, both removal of discharge products and prevention of filming can be achieved.

With the present embodiment, when a printing test of 30,000 sheets is performed, image deletion due to discharge products, filming and the like do not occur.

Herein, similarly to the first embodiment, the toner retention apparatus 500 may be slidingly moved in the direction of the rotation axis K (see FIG. 5). Such sliding in the rotation axis K direction can also be applied to the third and further embodiments which are described hereafter.

Moreover, similarly to the first embodiment, the nonwoven fabric 208 may use a nonwoven fabric in accordance with required characteristics (with or without conductivity, combining plural varieties of fibers, etc.).

Furthermore, toner may be preparatorily retained at the nonwoven fabric 208 beforehand, to raise discharge product removal characteristics from startup. Further, a rotating roller-type toner retention apparatus which utilizes a non-fabric roller could be used (see FIG. 9).

Further yet, in the present embodiment, the removal of the transfer residue toner which has adhered to the rotating brush 512 is performed by the recovering roller 514 featuring conductivity and the scraper 516, but is not limited thus. For example, removal by knocking against a flicking bar is also possible (refer to the third embodiment, which is described below).

Next, variant examples of the second embodiment will be described.

First, a first variant example will be described.

Figure 25A:
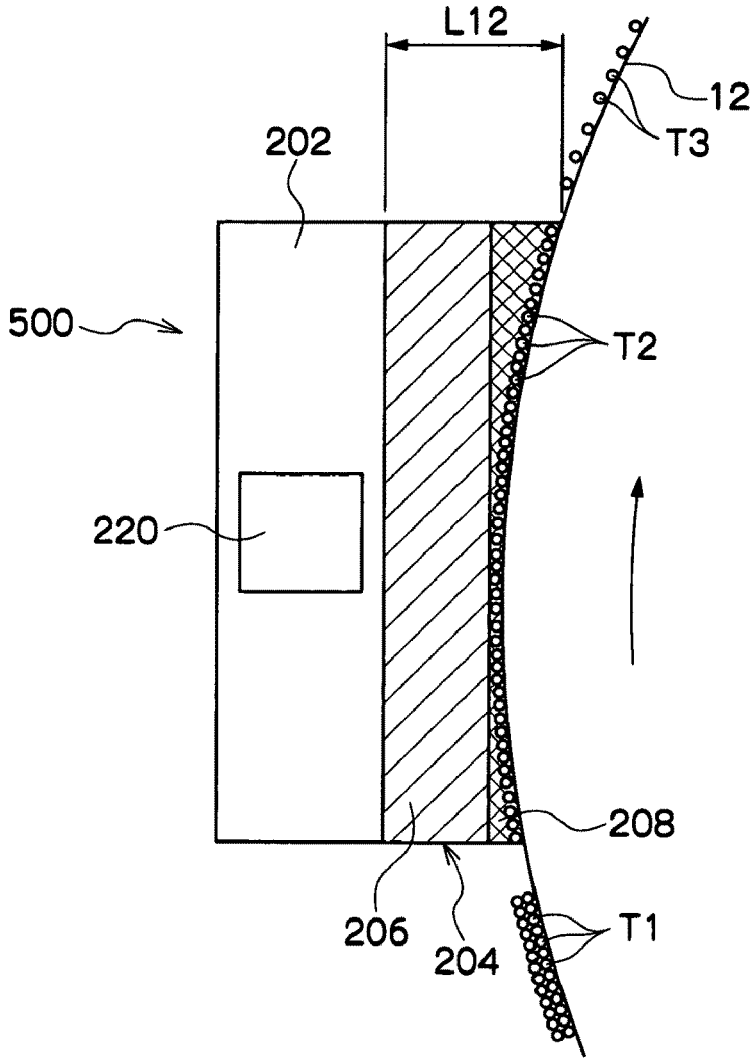
FIG. 25A is a view of a state in which a nonwoven fabric retains transfer residue toner.
Figure 25B:
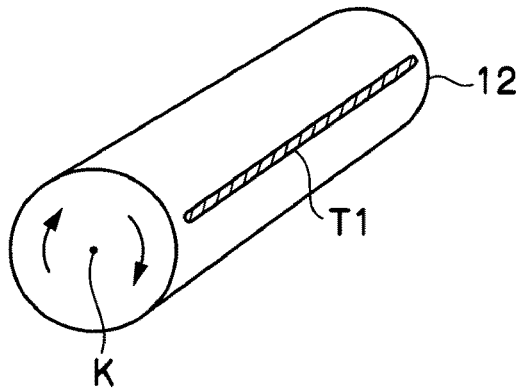
FIG. 25B is a schematic view in which a solid black image with a width of 3 cm is developed at a photosensitive drum.

Just after a power supply of the image formation apparatus comes on, a toner supply mode is set, and a 100% solid black image T1 with width 3 cm in the rotation axis K direction is developed on the photosensitive drum 12 (see FIG. 25B). At this time, transfer is off and the solid black image T1 is not transferred to the intermediate transfer belt 30 but, as shown in FIG. 25A, completely enters into the nonwoven fabric 208 and is retained (T2 in FIG. 25A). Toner T3 which is not retained is removed by the rotating brush 512. Note that the toner in FIG. 25A is schematically shown larger than in reality, in order to facilitate understanding.

Because this system is formed thus, when the device is delivered to a customer and power is initially turned on, the nonwoven fabric 208 is put into a state of retaining toner. Hence, it is possible to reliably remove discharge products from startup.

Next, a second variant example will be described.

A printing cycle of printing 100 sheets and resting for 3 seconds is referred to as a 'job'. At each job-end after printing onto 500 sheets, the toner supply mode is set and the 3 cm wide 100% solid black image T1 the same as in variant example 1 (the black line with width 3 cm, see FIG. 25B) is developed. At this time, transfer is off and the solid black image T1 is not transferred to the intermediate transfer belt 30 but completely enters into the nonwoven fabric 208 (see FIG. 25A).

Because this system is formed thus, the nonwoven fabric 208 is constantly in a state of retaining at least a predetermined amount of toner. Even if lopsided images (for example, patterns which are printed only at a right half) are continuously printed, the whole surface of the nonwoven fabric 208 of the toner retention apparatus 500 is periodically set to the state of retaining toner. Therefore, it is possible to more reliably remove discharge products over long periods.

Although it is here applied at the job-end after each 500 sheets, applications at job-starts are also possible, and applications at both are possible. Further, a number of sheets between applications of the toner supply mode is not limited to 500 sheets but may be suitably determined in accordance with the overall system of the device and the like, for example, each 200 sheets, each 1,000 sheets or the like.

Note that the first variant example and the second variant example may be implemented together.

Next, a third variant example will be described.

Given the first or second variant example, when the solid black image T1 is to be caused to completely enter the nonwoven fabric 208 rather than being transferred to the intermediate transfer belt 30, +200 V is applied to the nonwoven fabric. Thus, a greater proportion of the solid black image T1 is actively retained in large amounts (because the toner polarity of the solid black image T1 is the normal polarity (the negative polarity)). Toner that cannot be retained at this time is removed by the rotating brush 512 at the downstream side.

Because this system is formed thus, greater amounts can be retained at the nonwoven fabric 208, and hence discharge products can be more reliably removed.

Next, a fourth variant example will be described.

Given the first or second variant example, when the solid black image T1 is to be caused to completely enter the nonwoven fabric 208 rather than being transferred to the intermediate transfer belt 30, a voltage in which VAC (Vpp=800 V) is superposed with −200 V DC is applied to the nonwoven fabric, and greater amounts are retained. Toner that cannot be retained at this time is removed by the rotating brush 512 at the downstream side.

Because this system is formed thus, greater amounts can be retained at the nonwoven fabric 208, and hence discharge products can be more reliably removed.

Note that the first to fourth variant examples could also be applied to the first embodiment, and could also be applied to the third and further embodiments described hereafter.

Next, the third embodiment will be described. Here, members that are the same as in the first and/or second embodiments are assigned the same reference numerals, and duplicative descriptions are omitted.

Figure 20:
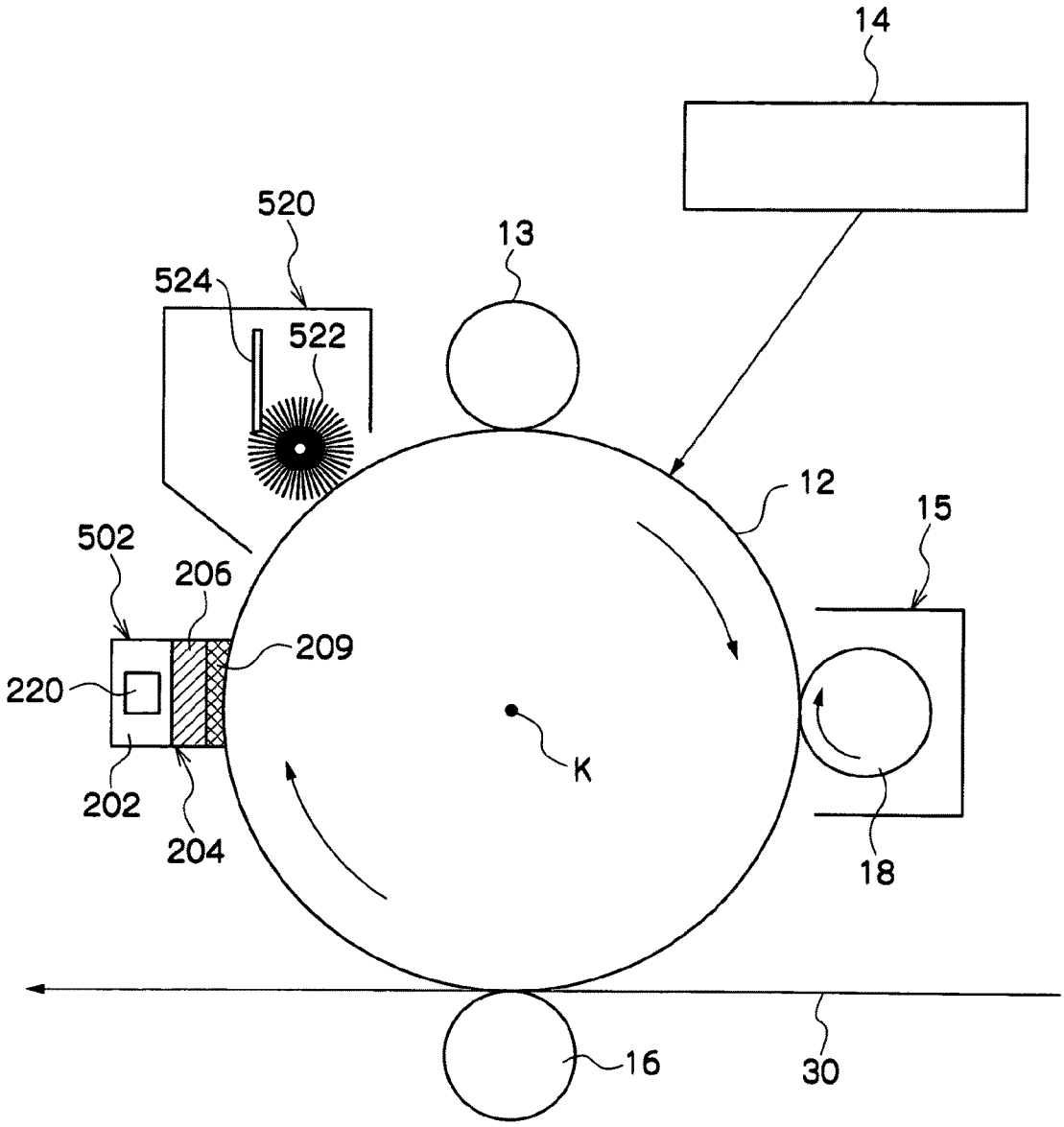
FIG. 20 is a diagram showing an image-forming unit of an image formation apparatus relating to a third embodiment of the present invention.

As shown in FIG. 20, a nonwoven fabric 209 is used at a toner retention apparatus 502 and is structured by insulative microfibers alone. In addition, a cleaning apparatus 520 is provided between the toner retention apparatus 502 and the contact charger 13.

The cleaning apparatus 520 is provided with a conductive rotating brush 522, which abuts against the photosensitive drum 12. A voltage in which VAC (Vpp=800 V) is superposed with −200 V DC is applied to the rotating brush 522. A flicking bar 524 abuts against the rotating brush 522.

The transfer residue toner adheres to and is retained at the nonwoven fabric 209. Transfer residue toner that has not been retained thereat adheres to and is removed by the rotating brush 522. The transfer residue toner that has adhered to and been removed by the rotating brush 522 is knocked off by the flicking bar 524 and recovered. Here, because the above-described DC+AC is applied to the rotating brush 522, the transfer residue toner can be recovered whether the polarity thereof is the normal polarity or the reverse polarity Next, operations of the present embodiment will be described.

With the nonwoven fabric 209 it is not necessary to charge-adjust the transfer residue toner, and conductivity is rendered unnecessary. Therefore, it is possible to structure it just with microfibers with large toner retentivity. As a result, it is possible to raise the discharge product removal capability.

Here, the transfer residue toner which adheres to and is eliminated by the rotating brush 522 may be recovered by a member other than the flicking bar 524. Further, a structure is also possible which uses plural rotating brushes, and removes transfer residue toner of respective polarities (the normal polarity and the reverse polarity) with respective rotating brushes.

With the present embodiment, a test of printing 30,000 sheets is performed, and image deletion due to discharge products, filming and the like do not occur.

Next, a fourth embodiment will be described. Here, members that are the same as in the first to third embodiments are assigned the same reference numerals, and duplicative descriptions are omitted.

Figure 21:
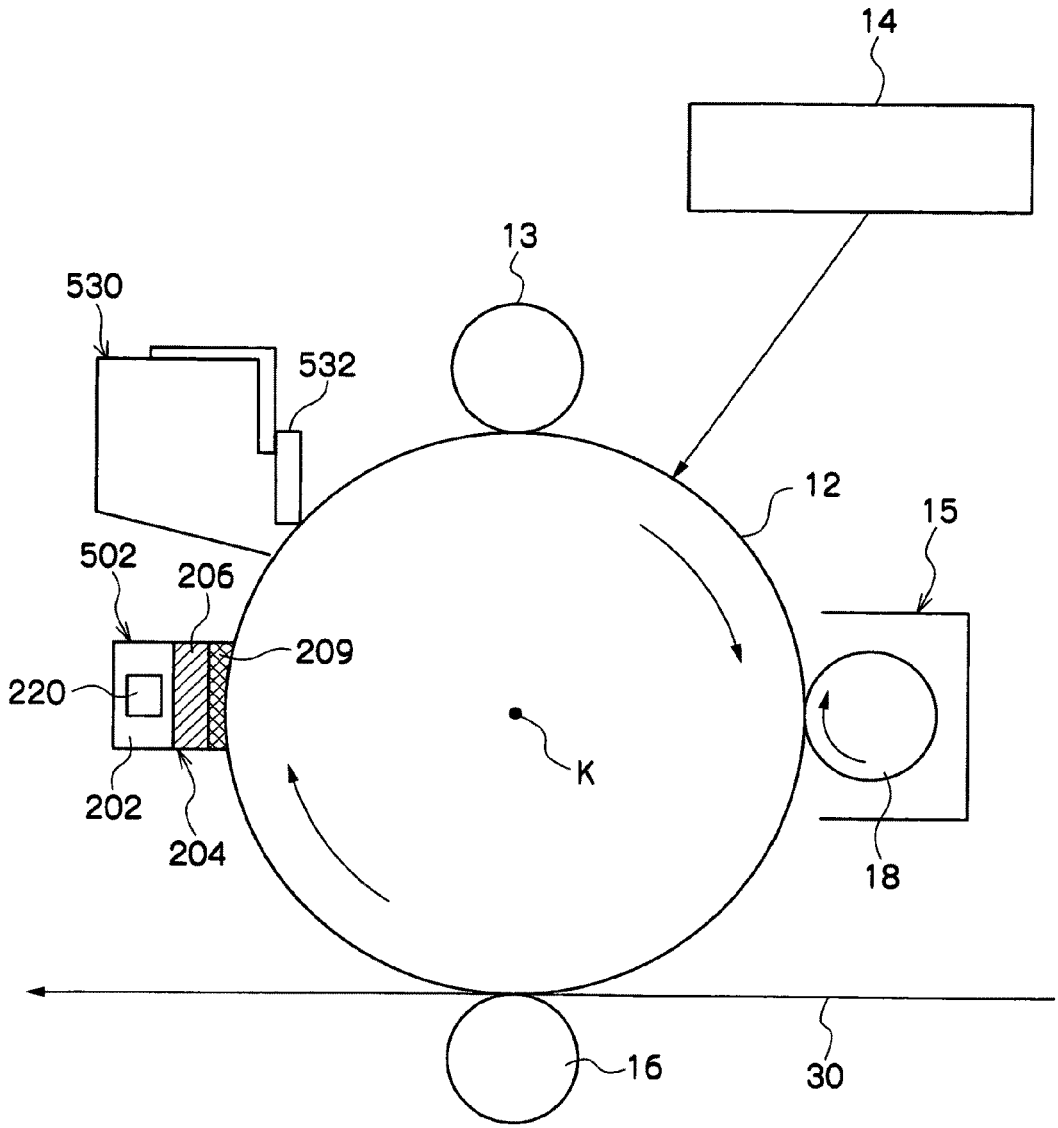
FIG. 21 is a diagram showing an image-forming unit of an image formation apparatus relating to a fourth embodiment of the present invention.

As shown in FIG. 21, the nonwoven fabric 209 is used at the toner retention apparatus 502 and is structured by insulative microfibers alone. In addition, a cleaning apparatus 530 is provided between the toner retention apparatus 502 and the contact charger 13. The cleaning apparatus 530 is equipped with a cleaning blade 532 which abuts against the photosensitive drum 12.

The transfer residue toner adheres to and is retained at the nonwoven fabric 209. Transfer residue toner that has not been retained thereat is scraped off and removed by the cleaning blade 532.

Next, operations of the present embodiment will be described.

If an abutting force of the cleaning blade 532 is raised, discharge product removal capability is improved. However, when the abutting force of the cleaning blade 532 is raised, because of an increase in a friction coefficient due to adherence of discharge products, curling of the cleaning blade 532 and squealing occur. Further, notching of the blade edge, cleaning failures and the like occur. Further still, filming and scratching (damage) are more likely to occur.

However, because the discharge products are removed by the toner retention apparatus 502, there is no need for the abutting force of the cleaning blade 532 to be made any higher than is necessary.

That is, it is possible to achieve both removal of discharge products and prevention of filming, while curling of the cleaning blade 532, squealing, notching of the blade edge, cleaning failures and the like which are caused by discharge products are prevented.

With the present embodiment, a test of printing 30,000 sheets is performed, and image deletion due to discharge products, filming and the like do not occur. Moreover, curling of the cleaning blade 532, squealing, notching of the blade edge, cleaning failures and the like also do not occur.

The nonwoven fabric here may be provided with conductivity, for example, to extract charge from the transfer residue toner, weaken an adherence force between the photosensitive drum 12 and the transfer residue toner, and facilitate the scraping off by the cleaning blade 532.

Next, a fifth embodiment will be described. Here, members that are the same as in the first to fourth embodiments are assigned the same reference numerals, and duplicative descriptions are omitted.

Figure 22:
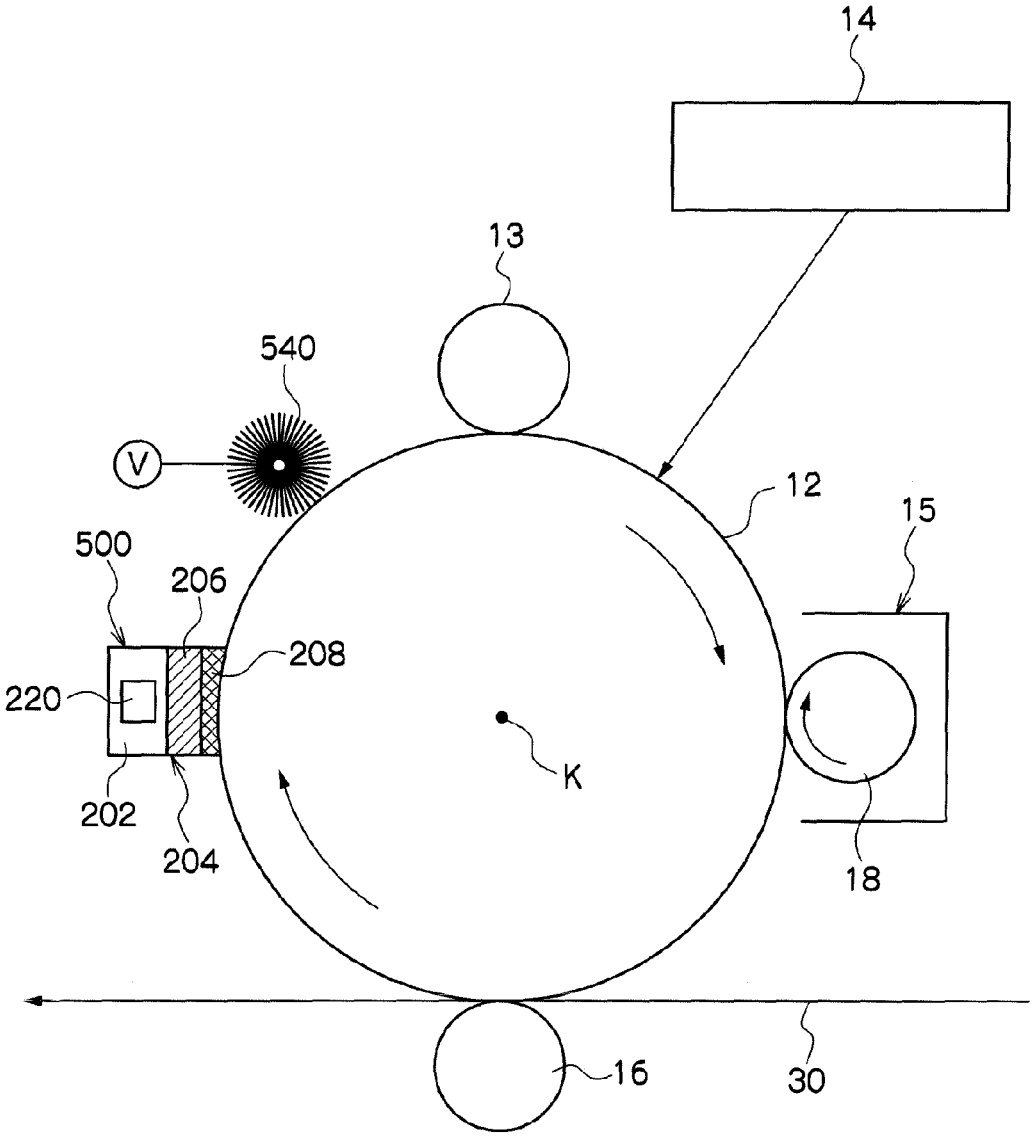
FIG. 22 is a diagram showing an image-forming unit of image formation apparatus relating to fifth and sixth embodiments of the present invention.

As shown in FIG. 22, the toner retention apparatus 500, which is equipped with the nonwoven fabric 208 featuring conductivity which abuts against the photosensitive drum 12, is disposed at the downstream side of the primary transfer roller 16. A voltage in which VAC (Vpp=800 V) is superposed with −200 V DC is applied to the nonwoven fabric 208. A conductive rotating brush 540 is provided between the toner retention apparatus 500 and the contact charger 13.

The transfer residue toner is retained at the nonwoven fabric 208. Here, because the voltage in which VAC (Vpp=800 V) is superposed with −200 V DC is applied to the nonwoven fabric 208, the transfer residue toner is retained in large amounts. Transfer residue toner that has not been retained thereat is recovered at the rotating brush 540, by +200 V DC being applied to the rotating brush 540. (It is desirable to form a system in which toner which enters into the rotating brush 540 is substantially all at the normal polarity (negative polarity).)

At a predetermined timing (in the present embodiment, each 100 sheets), the transfer residue toner that has been recovered and retained by the rotating brush 540 is ejected to the photosensitive drum 12 by switching the voltage applied to the rotating brush 540 to −600 V (an ejection mode). This ejected transfer residue toner is recovered by the developing apparatus 15. Transfer residue toner that is not recovered by the developing apparatus 15 is transferred onto the intermediate transfer belt 30 and is recovered by the intermediate transfer belt cleaner 33.

Next, operations of the present embodiment will be described.

Similarly to the first embodiment, the present embodiment is not provided with a special cleaning mechanism section for removing and retrieving transfer residue toner on the photosensitive drum 12, so has lower costs. Further, because the toner retention apparatus 500 eliminates discharge products, it is possible to form excellent images over long periods.

Next, a sixth embodiment will be described. Here, basic structure is the same as in the fifth embodiment, so description will similarly be given using FIG. 22.

The conductive rotating brush 540 is provided between the toner retention apparatus 500 and the contact charger 13. DC −850 V is applied to the rotating brush 540.

The transfer residue toner is retained at the nonwoven fabric 208. Here, a voltage in which VAC (Vpp=800 V) is superposed with −200 V DC is applied to the nonwoven fabric 208, so the transfer residue toner is retained in large amounts. The transfer residue toner that has not been retained is made even to the normal polarity (negative polarity) by discharges due to −850 V DC being applied to the rotating brush 540. This transfer residue toner which has been set to the normal polarity slides past the contact charger 13, and is recovered at the developing apparatus 15 in a similar manner to the first embodiment.

The rotating brush 540 performs charging adjustment of the transfer residue toner, while simultaneously retaining a portion of the transfer residue toner at the reverse polarity (positive polarity). Hence, at a predetermined timing (in the present embodiment, each 100 sheets), the reverse polarity (positive polarity) toner is ejected onto the photosensitive drum 12 by switching of the voltage to +200 V (an ejection mode). This reverse polarity (positive polarity) toner is transferred to the intermediate transfer belt 30 by the transfer voltage being switched to the normal polarity (negative polarity), and is hence recovered by the intermediate transfer belt cleaner 33.

Next, operations of the present embodiment will be described.

Similarly to the first embodiment, the present embodiment is not provided with a special cleaning mechanism for removing transfer residue toner on the photosensitive drum 12, so has lower costs. Further, because the toner retention apparatus 500 eliminates discharge products, it is possible to form excellent images over long periods.

In the first embodiment, the residue toner charger 200 for charging the transfer residue toner is also used for removal of discharge products (i.e., the toner retention apparatus). In the present embodiment however, the rotating brush, for charging and also temporarily retaining the transfer residue toner, and the toner retention apparatus 500, for removing the discharge products, are separated. Thus, because these functions are divided, it is possible to select the nonwoven fabric (microfiber diameter, etc.) to be more suitable for the removal of discharge products. Therefore, discharge product removal capability can be raised relative to the first embodiment.

Next, a seventh embodiment will be described. Here, members that are the same as in the first to sixth embodiments are assigned the same reference numerals, and duplicative descriptions are omitted.

Figure 23:
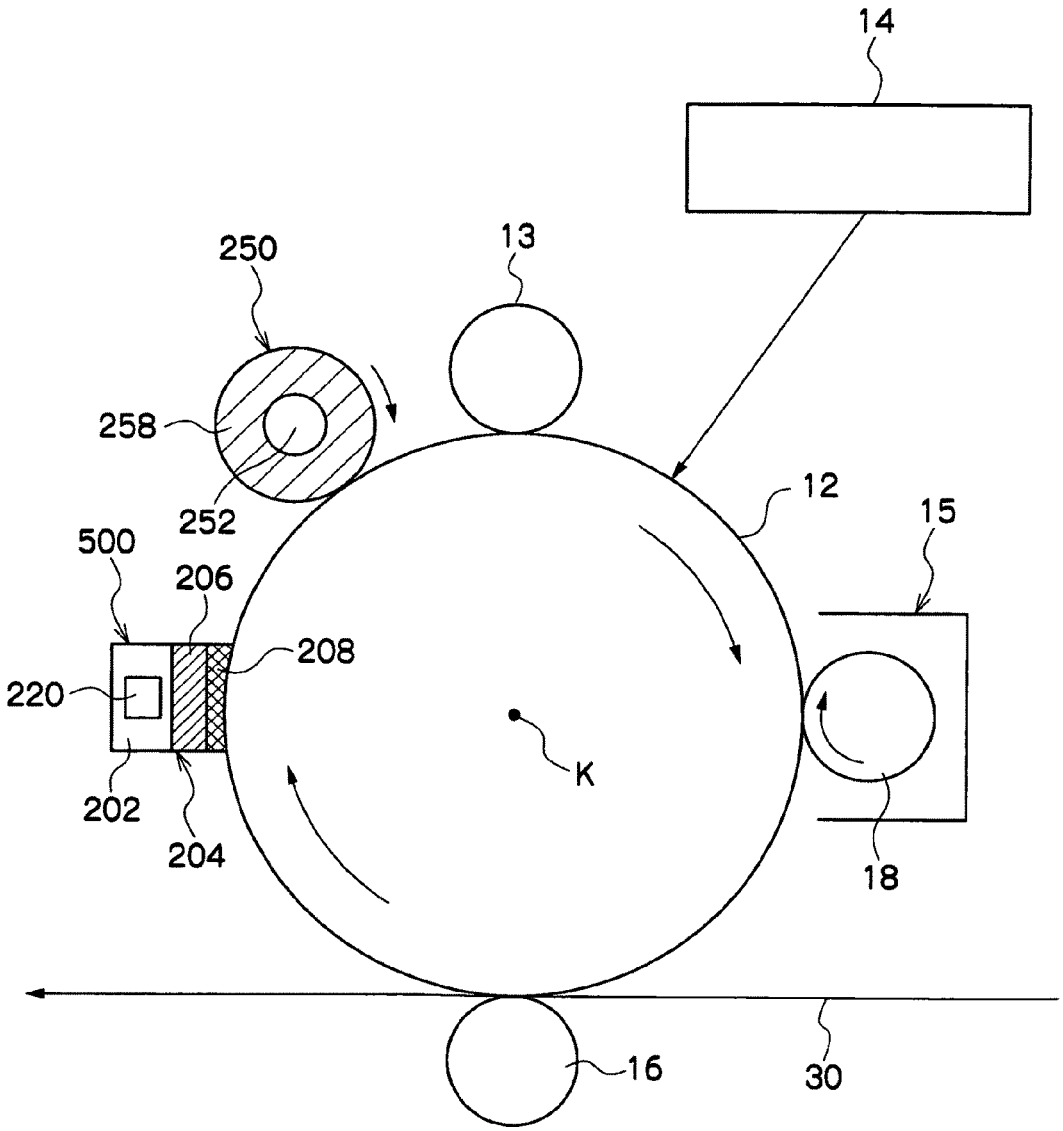
FIG. 23 is a diagram showing an image-forming unit of an image formation apparatus relating to a seventh embodiment of the present invention.

As shown in FIG. 23, the toner retention apparatus 500, which is equipped with the nonwoven fabric 208 featuring conductivity which abuts against the photosensitive drum 12, is disposed at the downstream side of the primary transfer roller 16. DC+200 V is applied to the nonwoven fabric 208.

The rotating-type residue toner charger 250 is provided between the toner retention apparatus 500 and the contact charger 13, to serve as a residue toner-charging section. DC −850 V is applied to the nonwoven fabric roller 258.

The transfer residue toner is retained at the nonwoven fabric 208. Here, because +200 V DC is applied to the nonwoven fabric 208, transfer residue toner at the normal polarity (negative polarity) is retained. Of transfer residue toner that has not been retained thereat, both negative toner and positive toner are made even to the normal polarity (negative polarity) by discharges due to the −850 V DC which is applied to the nonwoven fabric roller 258. This transfer residue toner which has been set to the normal polarity slides past the contact charger 13 and is recovered at the developing apparatus 15.

Next, operations of the present embodiment will be described.

Similarly to the first embodiment, the present embodiment is not provided with a special cleaning mechanism section for removing residue toner on the photosensitive drum 12, so has lower costs. Further, because the toner retention apparatus 500 removes discharge products, it is possible to form excellent images over long periods.

Moreover, with the structure of the present embodiment, if a charging VAC is set to "shoulder+7%" (see FIG. 16), there is almost no charging variation, and excellent image formation is possible. Thus, the generation of discharge products is suppressed. Furthermore, when a test of printing 30,000 sheets is performed, image deletion due to discharge products, filming and the like do not occur.

When the two of the nonwoven fabric 208, which principally performs removal of discharge products, and the nonwoven fabric roller 258, which principally performs charging of the transfer residue toner, are provided, as in the present embodiment, the nonwoven fabrics can be appropriately selected for their respective purposes. Further, although the nonwoven fabric roller 258 principally performs charging of the transfer residue toner, a discharge product removal capability thereof is higher than that of a conventional brush.

Figure 24:
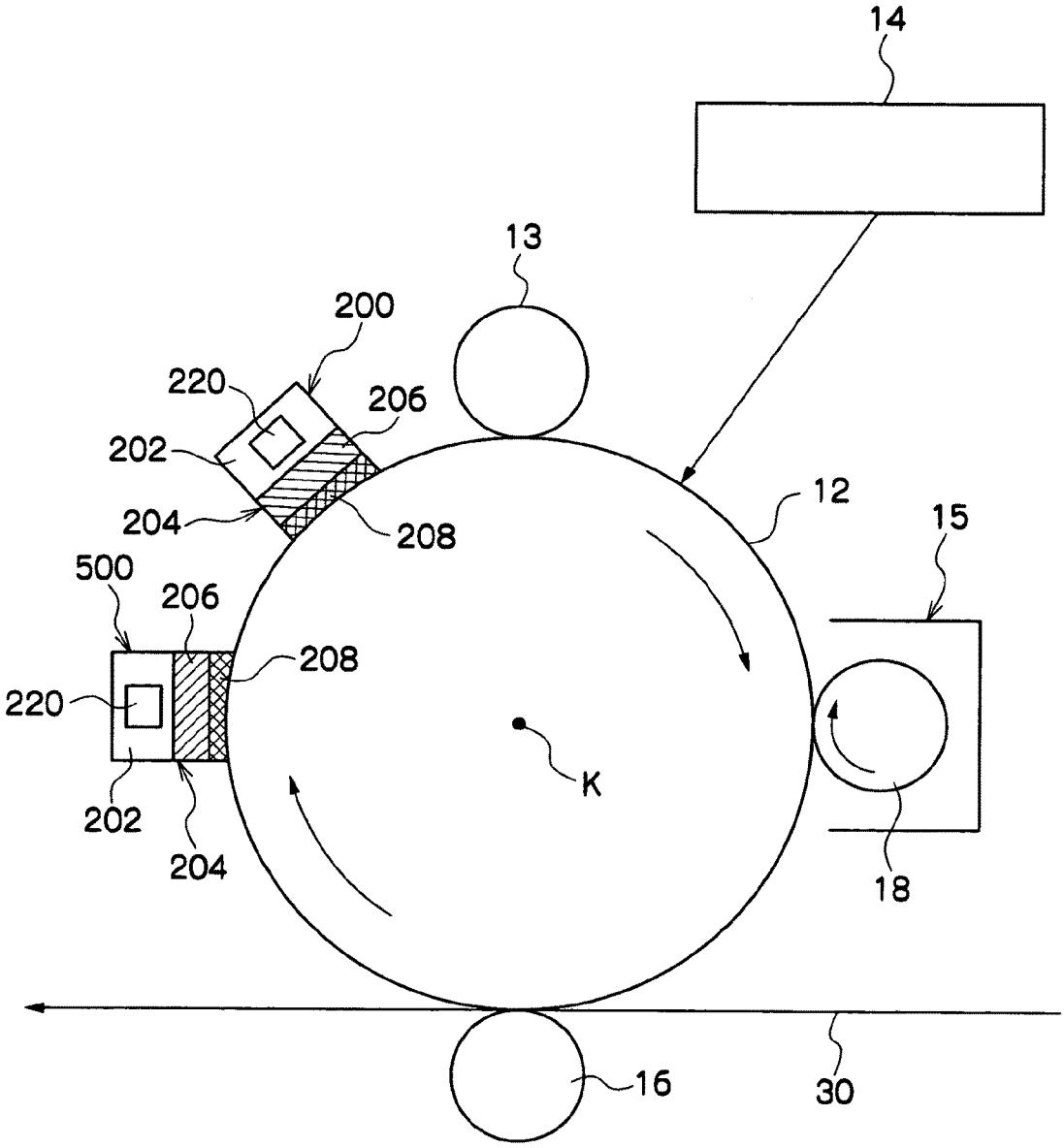
FIG. 24 is a diagram showing an image-forming unit of an image formation apparatus relating to a variant example of the seventh embodiment of the present invention.

As a variant example, it is also possible for the rotating-type residue toner charger 250 to be formed as the fixed-type residue toner charger 200, as in FIG. 24. Alternatively, although not illustrated, it is also possible to use two of the rotating-type residue toner charger 250. Further yet, it is possible to form a rotating-type toner retainer at the upstream side and the fixed-type residue toner charger 200 at the downstream side.

Further still, a structure is also possible which is provided with a conventional brush (for example, the fixed brush 302 of FIG. 10 or the like) at the upstream side of the residue toner chargers 200 and 250.

Figure 26A:
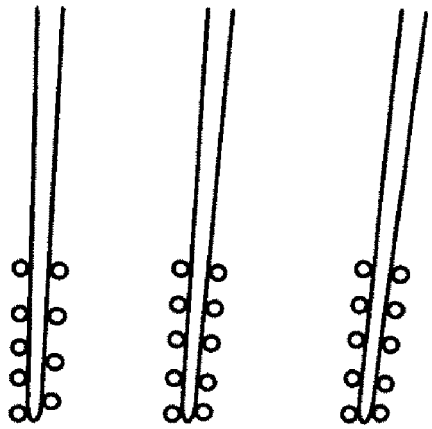
FIG. 26A is a view in which a state in which a brush retains toner is observed with a scanning electron microscope.
Figure 26B:
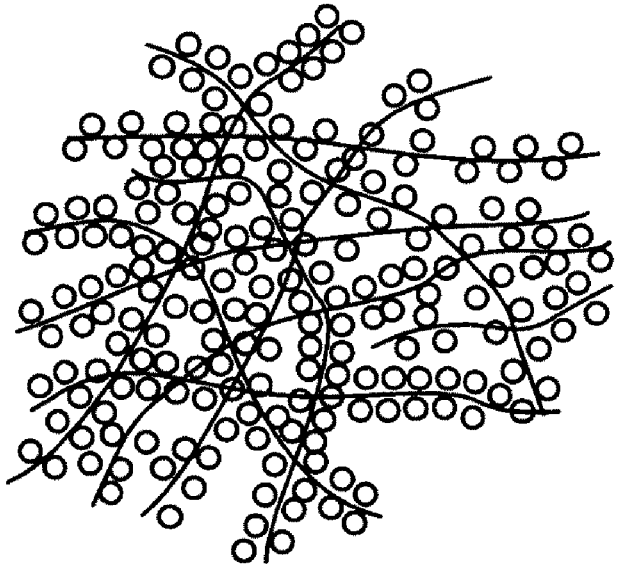
FIG. 26B is a view in which a state in which a nonwoven fabric retains toner is observed with a scanning electron microscope.

Now, FIGS. 26A and 26B are views schematically showing results of respective observations with a scanning electron microscope (SEM) of, in FIG. 26A, a state of adherence of toner at a conventional brush and, in FIG. 26B, a state of adherence of toner at a nonwoven fabric used in the above embodiments. As can be understood from these views, toner can be seen to adhere more densely to the nonwoven fabric (FIG. 26B) than the brush (FIG. 26A). Accordingly, it is thought that discharge product removal characteristics and transfer residue toner-charging characteristics are higher because the toner adheres in high density to a surface of contact with the photosensitive drum. Therefore, similar operational effects can be expected even with a member other than a nonwoven fabric, as long as the member can retain toner at a surface layer (the surface contacting the photosensitive drum) more densely than a conventional brush. Therefore, in any of the above-described embodiments, it is possible to use a member other than a nonwoven fabric as a toner retention member.

In the structure of Japanese Patent Application Laid-Open (JP-A) No. 2002-258666, JP-A No. 2003-333805 or the like, a nonwoven fabric is used but, because the nonwoven fabric touches against a photosensitive drum at a downstream side relative to a cleaning blade, the nonwoven fabric does not retain toner. Therefore, unlike the present invention, a discharge product removal capability is low.

Figure 27:
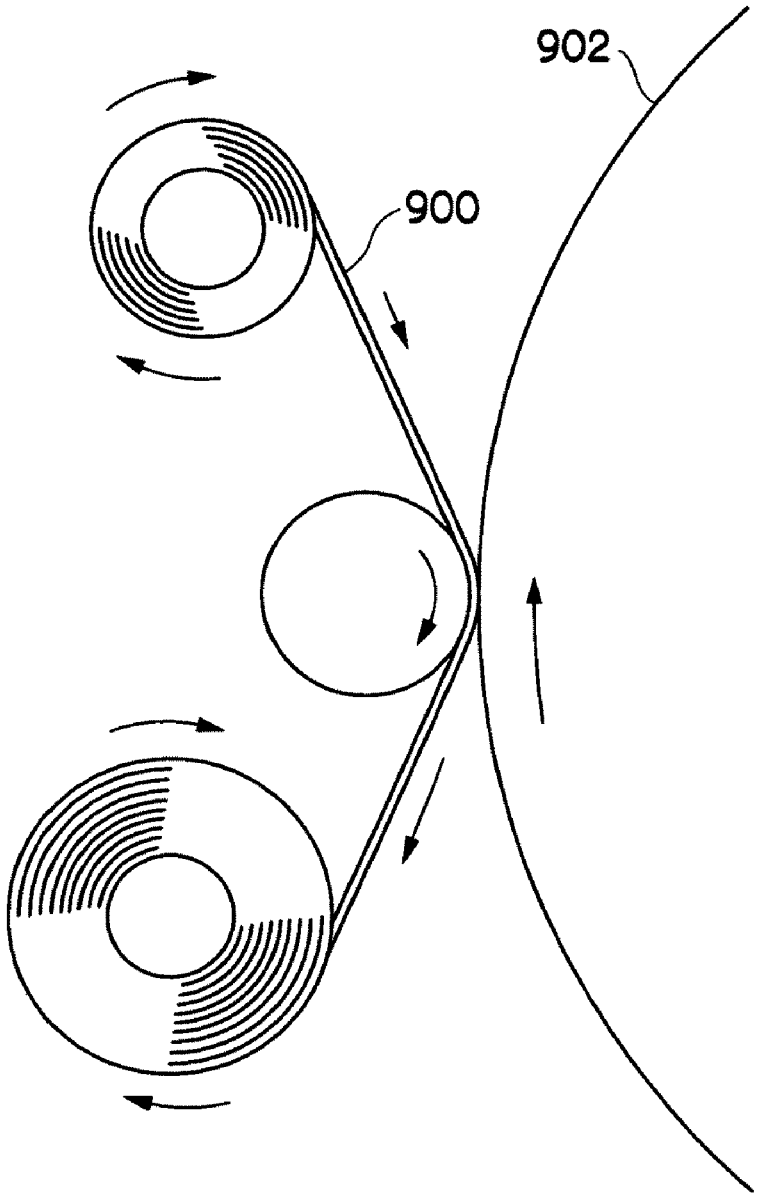
FIG.27 RELATED ART
FIG. 27 is a diagram schematically showing an image formation apparatus with a structure which winds a nonwoven fabric.

With the structure of JP-A No. 2001-249592, which is shown in FIG. 27, toner enters the nonwoven fabric 900 but, because the nonwoven fabric 900 is used by winding, a state in which toner is retained at a surface of contact with the photosensitive body 902 is not attained. Therefore, unlike the present invention, a discharge product removal capability is low.

Next, investigations of relationships between transfer residue toner retention amounts, which are retained by the nonwoven fabric serving as a toner retention member, and discharge product removal capabilities, and results of the investigations will be described.

First, a trial process will be described.

—Trial 1—

(1) To a photosensitive drum which a certain amount of toner is preliminarily developed at and adhered with, a nonwoven fabric alone is abutted, the photosensitive drum is rotated, and a predetermined amount of toner is retained at the nonwoven fabric.

(2) A charging roller alone is abutted against a different photosensitive drum from (1). A predetermined voltage is applied to the charging roller to cause discharging while the photosensitive drum is rotated for a certain amount of time. Thus, a photosensitive drum to whose surface discharge products are adhered is produced.

(3) The nonwoven fabric produced by (1) which has been caused to retain the predetermined amount of toner is abutted against the photosensitive drum produced by (2) to which discharge products have been adhered. The photosensitive drum is turned for a predetermined amount of time, after which the water contact angle is measured and a degree of recovery (a degree of removal of discharge products) is examined. (Refer to 'test 1 ' for the relationship between water contact angle and discharge products.)

—Trial 2—

At an image formation apparatus with a structure the same as the second embodiment (see FIG. 19), a toner amount that the nonwoven fabric 208 retains is controlled so as to be a predetermined toner retention amount, and continuous paper-feeding is performed. Thus, a relationship between toner retention amounts and image deletion is observed.

Here, the management such that the toner amount that the nonwoven fabric 208 retains is the predetermined toner retention amount is implemented by the following method.

In order to study the effect of toner retention amounts, the present test is a modelling experiment. Accordingly, changes in image density and adjustments of the voltage applied to the toner retention member are implemented, and the toner retention amount at the toner retention member is adjusted in a modelling style.

Trial conditions of the above described trial 1 and trial 2 are shown below.

Nonwoven fabric

Material: polyester/nylon

Mesh: 85 g/m$^2$

Thickness: approx. 500 μm

Processing direction breadth: approx. 5 mm

Contact pressure against photosensitive body: approx. 0.8 g/mm

Other: applied to 3 mm-thick urethane sponge with double-sided tape

Processing Speed: 104 mm/s

Photosensitive drum diameter: Φ30 mm

Trial environment: 28° C./85% (i.e., a high-temperature, high-humidity environment)

Recording paper: A4, lateral feeding (trial 2)

Paper-feed count: 6,000 sheets/day×10 days=60,000 sheets total (trial 2)

Toner retention amounts (g/m$^2$): 0, 2, 4, 10, 20, 100, 150, 200, 250, 300, 350

Next, trial results of trial 1 and trial 2, and relationships between transfer residue toner retention amounts and discharge product removal capabilities will be described in accordance with the trial results.

Figure 28:
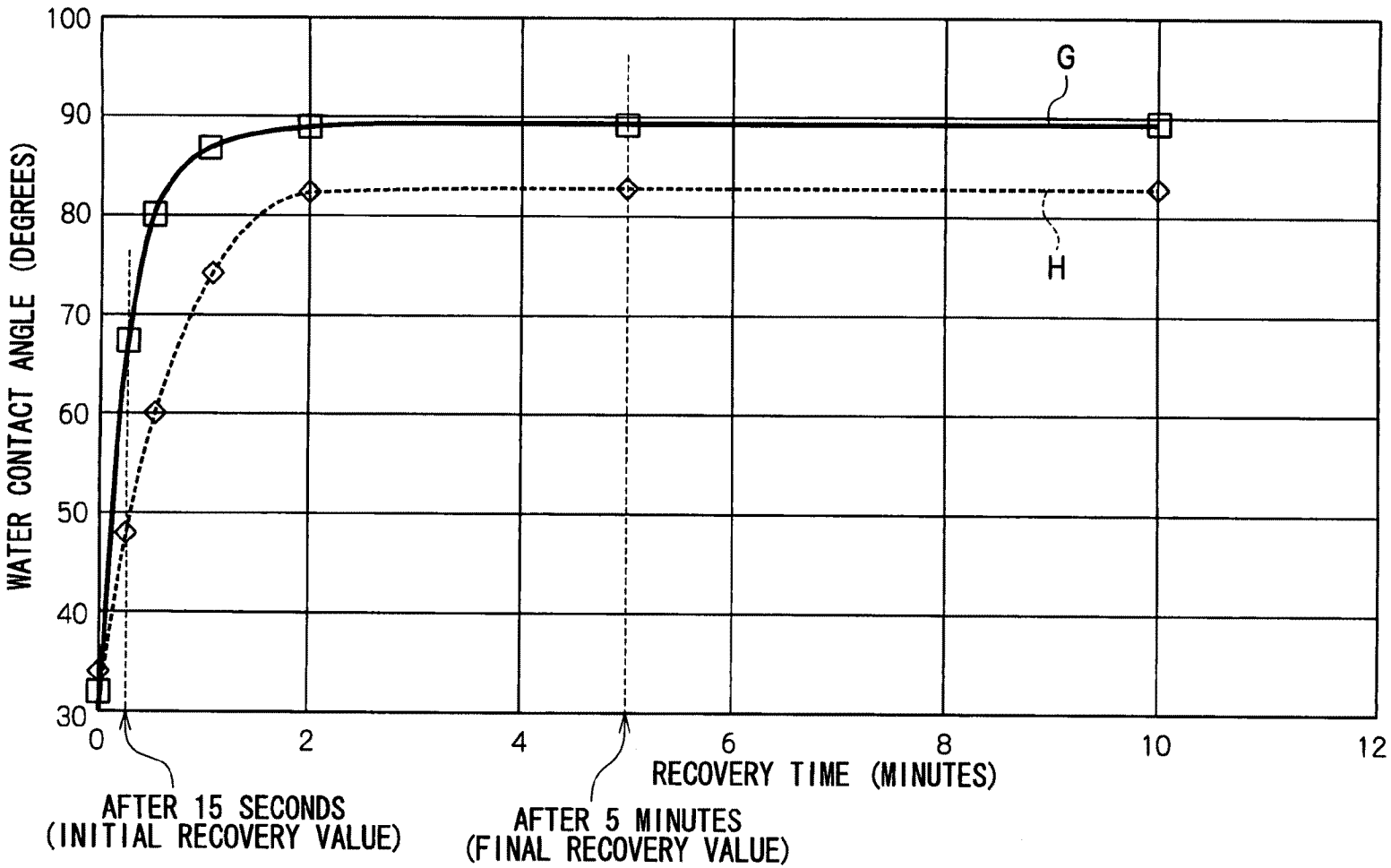
FIG. 28 is a graph showing results of trial 1, which shows recovery curves which are relationships between rotation periods and water contact angles.

The graph of FIG. 28 shows relationships between photosensitive drum rotation durations and water contact angles of trial 1 (i.e., recovery curves).

According thereto, the water contact angle rapidly recovers in a turning duration of a little less than two minutes and is thereafter stable.

Note that, because of difficulty of interpretation, the graph of FIG. 28 shows only two representative recovery curves (G and H), but water contact angle recovery curves are found for each of the toner retention amounts (g/m$^2$): 0, 2, 4, 10, 20, 100, 150, 200, 250, 300 and 350.

In these results, overall forms of the graphs for each toner retention amount are the same (a tendency to rapidly recover over a rotation duration of a bit less than two minutes and then stabilize). However, as with the recovery curves G and H, inclinations at rising and values at being stable differ in accordance with the toner retention amounts.

Accordingly, values after 15 seconds are taken as representative of the rising inclinations, and these values serve as initial recovery values. Further, values after 5 minutes are taken as representative of the values which are stable, and these values serve as final recovery values.

Figure 29:
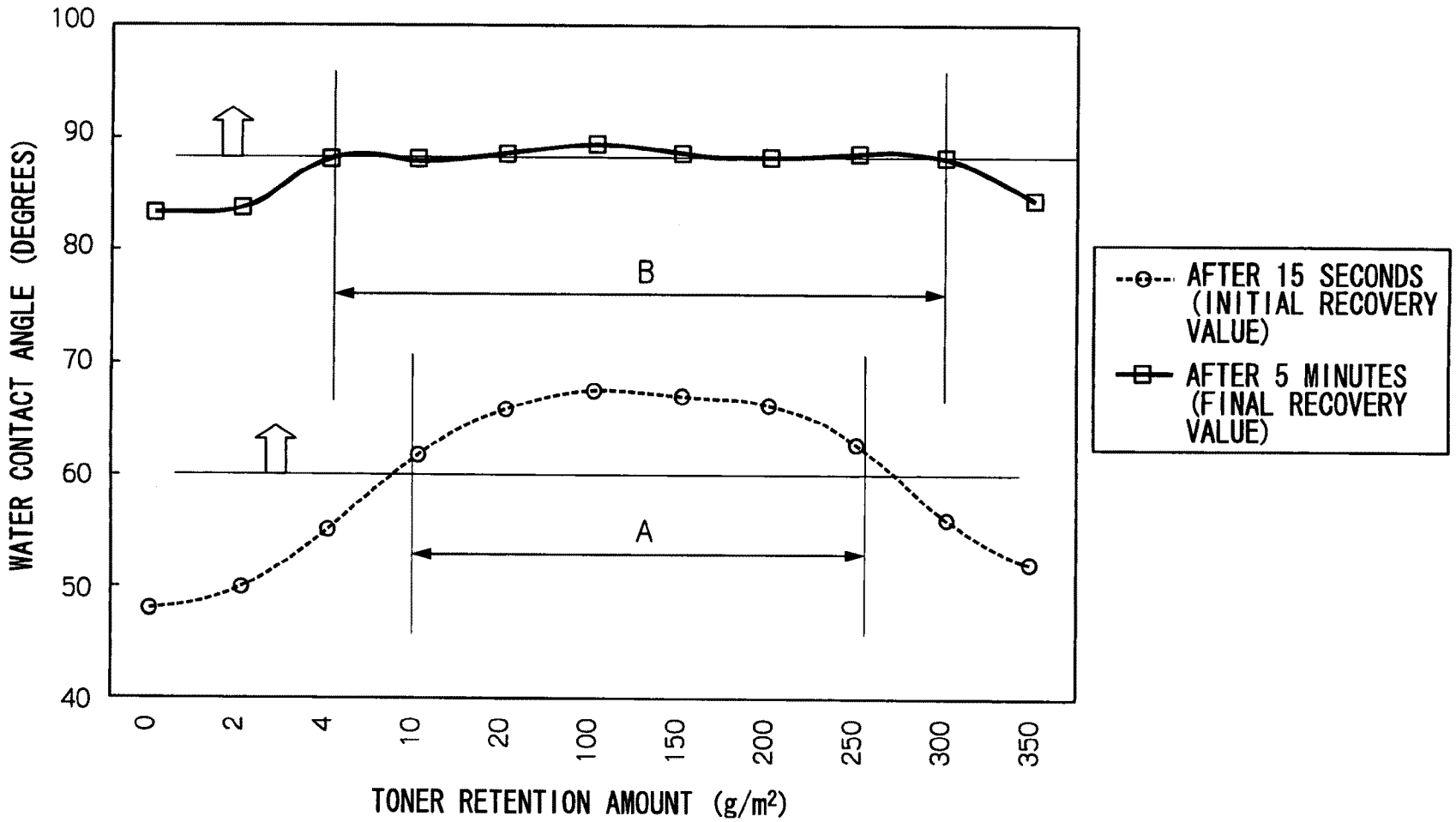
FIG. 29 is a graph showing results of trial 1, which shows relationships between initial recovery values and final recovery values.

The graph of FIG. 29 is a graph showing relationships between these initial recovery values and final recovery values and the toner retention amounts.

As can be understood from this graph, water contact angle recovery characteristics (both the initial recovery value and the final recovery value) improve as the toner retention amount increases, and saturate at a certain amount and above. It is also observed that the characteristics deteriorate when the toner retention amount is increased further.

The results of paper-feeding tests with the trial apparatus of trial 2 are shown in the table of FIG. 30. As can be seen from this table, similarly, image deletion occurs less as the toner retention amount increases, but if the toner retention amount is increased too far, it is observed that image deletion arises again.

In the table of FIG. 30, 'just after continuous paper-feeding' refers to a 6,000-th image at the end of paper-feeding of 6,000 sheets, and 'after long-duration standing (long periods of inactivity)' refers to an image which is printed first after at least several hours of inactivity (for the present trial, after 12 hours) subsequent to paper-feeding of 6,000 sheets in a day.

Image deletion is more likely to occur after a long duration of standing than during continuous paper-feeding or just after paper-feeding. This is thought to be because moisture in the atmosphere is absorbed during long periods of inactivity, making image deletion more likely to occur. Further, image deletion just after a long period of inactivity is remarkable when standing in a high-temperature, high-humidity environment, as in the conditions of the present trials.

Further, in the table of FIG. 30, 'removal mode' refers to a mode of printing after several minutes (about five minutes in the present trials) of idle turning of the rotation drum subsequent to a long period of inactivity. When such a removal mode is performed, image deletion tends to be recovered. This is thought to be because, when the photosensitive drum is idle-turning, the nonwoven fabric which retains toner is removing discharge products and moisture is evaporating, and thus image deletion is recovered.

Next, appropriate toner retention amounts will be described.

If the initial recovery value of the water contact angle after 15 seconds in trial 1 (see FIG. 29) is at least approx. 60°, image deletion does not occur in the paper-feeding test of trial 2 (see FIG. 30) at during continuous paper-feeding, just after paper-feeding, further including after long-duration standing. A range which satisfies this condition, which is to say, an appropriate range of toner retention amounts, is 10 to 250 g/m$^2$, which is range A in Figure.

Even if the initial recovery value of the water contact angle after 15 seconds in trial 1 is less than approx. 60°, if the final recovery value after five minutes from commencing rotation has recovered to 89°, even though in a case of after long-duration standing at which image deletion is likely to occur, it is possible to prevent image deletion by introduction of the removal mode. A range which satisfies such conditions, which is to say, an appropriate range of toner retention amounts, is 4 μm$^2$ to 300 g/m$^2$, which is range B in Figure.

Thus, an optimum suitable range of toner retention amounts is range A in Figure, which is 10 g/m$^2$ to 250 g/m$^2$, and a suitable range of toner retention amounts in cases in which the recovery mode is included is range B in Figure, which is 4 g/m$^2$ to 300 g/m$^2$.

More detailed descriptions are given below.

—Toner Retention Amount 2 g/m$^2$—

In trial 1, the initial recovery value and the final recovery value are substantially the same as in a case in which toner is not retained (0 g/m$^2$), and scraping off of discharge products is not realized.

In a paper-feeding test with the trial apparatus of trial 2, discharge products are not completely removed over about 3,000 sheets, and consequently dropouts (image deletion) occur on print samples.

Further, when the surface of the nonwoven fabric is observed with an SEM (scanning electron microscope), amounts of toner adhered to and being on the surface of the nonwoven fabric are extremely small.

—Toner Retention Amount 4 g/m$^2$—

In trial 1, the initial recovery value is slightly improved in comparison with a nonwoven fabric which does not retain toner, but does not exceed 60°. The final recovery value substantially recovers to near 89°, which is the value of a new photosensitive drum which has not been exposed to discharges.

Until this complete recovery, a period of turning of at least several minutes is required. Accordingly, at a time of a situation in which image deletion is likely to occur, such as after a long period of inactivity or the like, it is thought that discharge product removal is possible even with a toner retention amount of this level if introducing of a mode of idle-turning for several minutes and removing discharge products over a period of time, that is, the removal mode, is possible.

In practice, in a paper-feeding test with the trial apparatus of trial 2, dropouts (image deletion) do not occur during continuous paper-feeding or just after paper-feeding, but dropouts do occur on an initial print sample of a following day, which is to say, after 12 hours of inactivity. However, if the removal mode which turns the photosensitive drum for 5 minutes before initial printing after inactivity is included, dropouts completely disappear from the prints. Thus, it can be said that this is a toner retention amount with which discharge product removal is possible when the removal mode is introduced.

In observation with an SEM, toner that remains adhered to fibers of the nonwoven fabric at the surface that contacts with the photosensitive drum is not copiously adhered to the whole of the abutting surface, but is greatly increased in comparison with the case of 2 mg/m$^2$.

—Toner Retention Amount 10 g/m$^2$—

In trial 1, the initial recovery value and the final recovery value are greatly improved.

In a paper-feeding test with the trial apparatus of trial 2, even when a total of 60,000 sheets—6,000 sheets a day for 10 days—have been completed, dropouts (image deletion) do not occur on print samples for any of during continuous printing, just after continuous printing and after long-duration standing. It is thought that when the toner retention amount is increased to this extent, discharge product removal characteristics are sufficiently raised and image deletion can be thoroughly prevented, even without introducing the removal mode before initial printing after a long period of inactivity.

—Toner Retention Amounts from 20 g/m$^2$ to 200 g/m$^2$—

In trial 1, initial recovery values and final recovery values are even more significantly improved. Between 20 g/m$^2$ and 200 g/m$^2$, the recovery curves of the water contact angle are substantially the same, and recovery characteristics are considered to be saturated with these toner retention amounts in the range from 20 g/m$^2$ to 200 g/m$^2$.

In paper-feeding tests with the trial apparatus of trial 2, dropouts (image deletion) do not occur on print samples for any of during continuous printing, just after continuous printing and after long-duration standing.

In observation with an SEM, for 20 g/m$^2$ to 200 g/m$^2$, the abutting surface contacting with the photosensitive drum is substantially completely covered with toner, which indicates that removal characteristics are saturated.

—Toner Retention Amount 250 g/m$^2$—

In trial 1, it is observed that recovery characteristics are poorer. However, the initial recovery value is 60° or more and the final recovery value is approx. 89° (about the same as with the toner retention amount of 10 g/m$^2$).

In paper-feeding tests with the trial apparatus of trial 2, dropouts (image deletion) do not occur on print samples either during continuous printing or after long-duration standing (about the same as with the toner retention amount of 10 g/m$^2$).

—Toner Retention Amount 300 g/m$^2$—

In trial 1, recovery characteristics are even poorer and the initial recovery value falls below 60°. However, the final recovery value substantially recovers to 89°, which is the value of a new photosensitive drum which has not been exposed to discharges.

Accordingly, similarly to with 4 g/m$^2$, it is thought that at the time of a situation in which image deletion is likely to occur, such as after a long period of inactivity or the like, discharge product removal is possible if the removal mode for idle-turning and removing discharge products over a period of time is introduced.

In practice, in a paper-feeding test with the trial apparatus of trial 2, similarly to with 4 g/m$^2$, dropouts do not occur during continuous paper-feeding or just after paper-feeding, but dropouts (image deletion) do appear on an initial print sample after 12 hours of inactivity. However, if the removal mode which idle-turns the photosensitive drum for 5 minutes before initial printing after a long period of inactivity is included, dropouts completely disappear from the prints. Thus, it can be said that this is a toner amount which can be used if the removal mode is included.

—Toner Retention Amount 356 g/m$^2$—

In trial 1, the initial recovery value and the final recovery value are lowered.

In a paper-feeding test with the trial apparatus of trial 2, discharge products are not completely removed over about 3,000 sheets, and consequently dropouts appear on print samples.

As has been described hereabove, retention of at least 4 g/m$^2$ of toner at a nonwoven fabric serving as a toner retention member is necessary, while retention of at least 10 g/m$^2$ of toner is more desirable. Further, for an upper limit, at most 300 g/m$^2$ is necessary while at most 250 g/m$^2$ of toner is more desirable.

Further, from the results of SEM observations of the contact surfaces of the nonwoven fabrics, it is understood that as the toner retention amount increases, amounts of toner adhering to the fibers of the nonwoven fabric surface increase, and in the range of toner retention amounts at which recovery characteristics are saturated, the fibers of the nonwoven fabric surface are copiously covered with toner.

Now, as trial 3, the following trial is performed.

Figure 31:
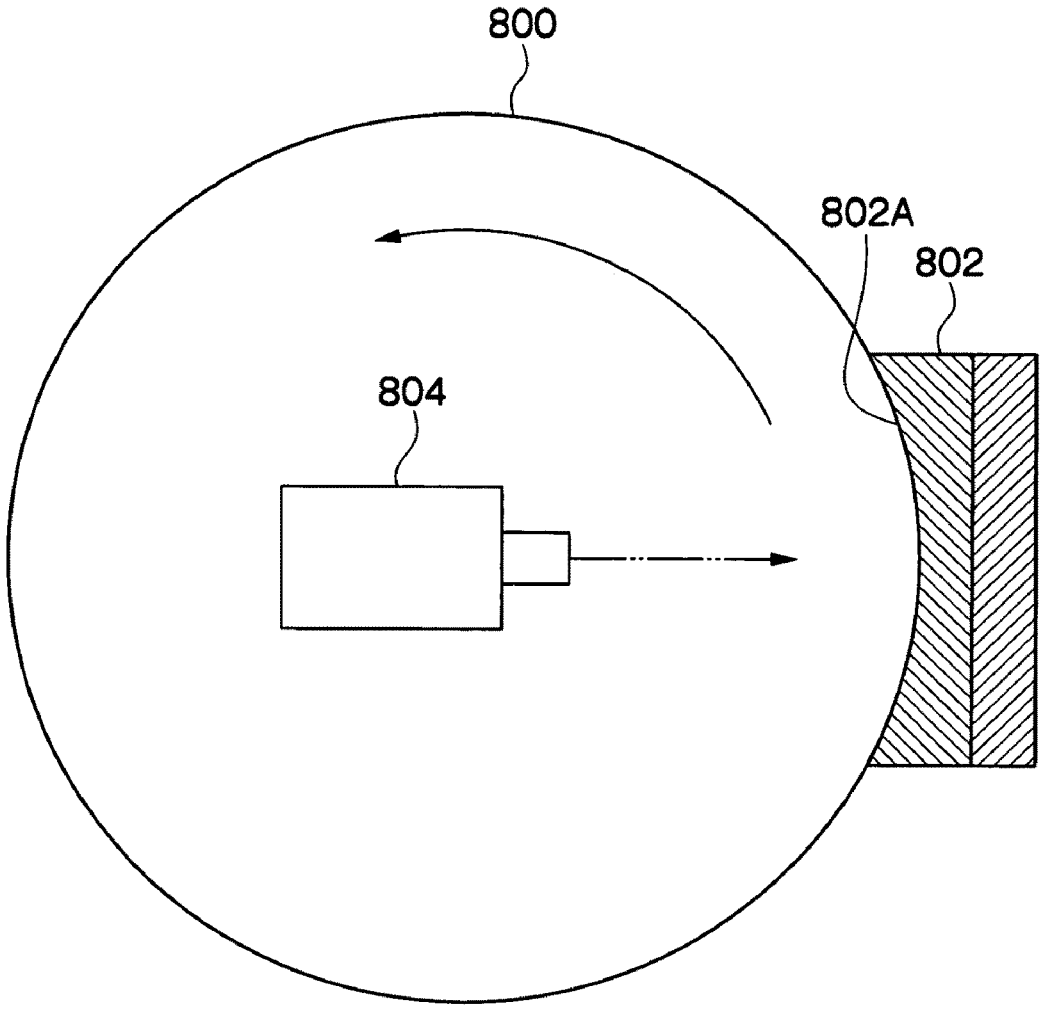
FIG. 31 is a schematic diagram for explaining an experimental process of trial 3.

As shown in FIG. 31, a nonwoven fabric 802 at which toner is retained is touched against a glass drum 800, and a contact surface 802A is photographed with a video camera 804 and inspected.

Results thereof are that, when the toner retention amount is an amount smaller than 250 g/m$^2$, small amounts of the toner of the contact surface 802A of the nonwoven fabric 802 detach, adhere to the drum and leave the nonwoven fabric 802. However, almost all the toner stays retained at the contact surface 802A On the other hand, with the aforementioned toner retention amounts at which recovery characteristics become poor, that is, cases in which 250 g/m$^2$ or more is retained at the nonwoven fabric 802, states in which the toner greatly detaches and flows onto the glass drum 800 are observed. It is also observed that larger amounts of toner flow out as the toner retention amount increases.

From these results of trial 3, a reason that discharge product removal characteristics deteriorate in states in which toner flows out, that is, when the toner retention amount is 250 g/m$^2$ or more, can be surmised as follows.

When toner is retained at the abutting surface of the nonwoven fabric, frictional forces act because a speed difference occurs between the surface of the photosensitive drum and the toner retained at the abutting surface, and discharge products are removed.

However, it is thought that when toner flows out rather than being retained at the abutting surface, the toner that flows out rests on the surface of the photosensitive drum, a speed difference between this toner and the photosensitive drum surface does not occur, and frictional forces do not act. Consequently, a capacity for removing discharge products is greatly reduced.

Next, a toner retention member other than the nonwoven fabric will be described.

As has already been mentioned, in any of the embodiments described above, it is possible to use a member other than a nonwoven fabric at the toner retention member.

For example, a fabric which is formed by knitting and/or weaving is used so as to be in surface contact with the photosensitive drum and, similarly to a nonwoven fabric, suitably retains toner at an abutting surface and provides a high discharge product removal capability. As a structure of a practical apparatus, the fabric may be substituted for the nonwoven fabrics of the embodiments which have been described hereabove. Therefore, illustrations and explanations of structures are omitted for cases in which the fabric is used.

Next, removal of discharge products when the fabric is used will be described in detail.

A fabric formed as a sheet in which nylon fibers featuring 0.2 d (denier) conductivity are interlaced, and a fabric formed as a sheet in which similar fibers are woven, are respectively substituted for the nonwoven fabric 208 of the second embodiment (see FIG. 19) and applied, and paper-feeding tests of 30,000 sheets are performed. Results thereof are that when these fabrics are used, similarly to the case in which the nonwoven fabric 208 is used, image deletion due to discharge products, filming and the like do not occur.

Further, the present inventors have confirmed that when these fabrics are used in structures of embodiments other than the second embodiment, high discharge product removal capabilities are featured.

The present inventors have also confirmed that effects are significant (discharge product removal capabilities are high) when fabrics formed with superfine fibers are used. Further, the present inventors have also confirmed that effects are more significant with fabrics formed of superfine microfibers, such as the 0.2-denier fibers mentioned above.

In general, superfine fibers means fibers finer than silk, of less than 1 dtex, and superfine microfibers means fibers of less than 0.1 dtex.

A denier is a unit of thread thickness, being a number of grams per 9,000 meters.

A decitex (dtex) is a unit of thread thickness, being a number of grams per 10,000 meters. Basically, a tex is a number of grams per 1,000 meters, and 'deci', meaning one-tenth, is appended to give, for example, 8.4 tex=84 decitex.

Note that the present invention is not limited to the embodiments described above and, obviously, suitable modifications are possible within a range not departing from the spirit of the present invention.

What is claimed is:

1. An image formation apparatus comprising:

an image-bearing body that rotates;

a charging section that charges the image-bearing body;

an exposure section that forms an electrostatic latent image on the image-bearing body that is charged;

a developing section that develops the electrostatic latent image and forms a toner image;

a transfer section that transfers the toner image to a transferred body; and a toner retention member that is provided at an upstream side of the charging section and a downstream side of the transfer section, and that includes a contact surface that contacts against the image-bearing body in surface-contact and retains transfer residue toner at the contact surface, wherein the toner retention member has plural layers structure including:

a layer of a fabric that includes the contact surface, a layer of a base member, and a layer of a resilience member disposed between the fabric and the base member.

2. The image formation apparatus of claim 1, wherein transfer residue toner to be retained by the toner retention member is supplied to the toner retention member at a predetermined timing.

3. The image formation apparatus of claim 2, wherein the predetermined timing is just after a power supply is on.

4. The image formation apparatus of claim 2, wherein the predetermined timing is each time a predetermined number of sheets are printed.

5. The image formation apparatus of claim 2, wherein voltage is applied to the toner retention member at least at a time of supply of the transfer residue toner.

6. The image formation apparatus of claim 5, wherein the voltage applied to the toner retention member comprises a bias voltage of opposite polarity to the supplied transfer residue toner.

7. The image formation apparatus of claim 5, wherein the voltage applied to the toner retention member comprises an AC voltage.

8. The image formation apparatus of claim 1, wherein, at a downstream side of the toner retention member and the upstream side of the charging section, a cleaning section that removes transfer residue toner is provided.

9. The image formation apparatus of claim 1, wherein, at a downstream side of the toner retention member and the upstream side of the charging section, a toner-processing section, that abuts against the image-bearing body and processes the transfer residue toner, is provided.

10. The image formation apparatus of claim 9, wherein the toner-processing section is a temporary retention section that removes and temporarily retains the transfer residue toner.

11. The image formation apparatus of claim 10, wherein the temporary retention section ejects the retained transfer residue toner to the image-bearing body at a predetermined timing.

12. The image formation apparatus of claim 11, wherein the toner-processing section is a residue toner-charging section that charges the transfer residue toner.

13. The image formation apparatus of claim 12, wherein the residue toner-charging section comprises a nonwoven fabric including conductivity, that contacts the image-bearing body.

14. The image formation apparatus of claim 12, wherein the toner retention member serves as the residue toner-charging section.

15. The image formation apparatus of claim 1, wherein the toner retention member comprises a nonwoven fabric that contacts the image-bearing body.

16. The image formation apparatus of claim 13, wherein the nonwoven fabric is formed with at least fibers including conductivity.

17. The image formation apparatus of claim 16, wherein the nonwoven fabric is formed with at least fibers which are coated with conductive resin.

18. The image formation apparatus of claim 13, wherein a fiber diameter Ø of fibers structuring the nonwoven fabric is $1.0\ \mu m \leqq Ø \leqq 20.0\ \mu m$.

19. The image formation apparatus of claim 1, wherein the toner retention member comprises a fabric which surface-contacts with the image-bearing body.

20. The image formation apparatus of claim 19, wherein the fabric is formed with fibers including at least conductive fibers.

21. The image formation apparatus of claim 19, wherein the fabric is formed with superfine fibers.

22. The image formation apparatus of claim 1, wherein an amount of the transfer residue toner that the contact surface of the toner retention member retains is at least 4 $g/m^2$ and at most 300 $g/m^2$.

23. The image formation apparatus of claim 22, wherein the amount of the transfer residue toner that the contact surface of the toner retention member retains is at least 10 $g/m^2$ and at most 250 $g/m^2$.

24. The image formation apparatus of claim 1, wherein a retention member-sliding section, that causes the toner retention member to slide in a direction of a rotation axis of the image-bearing body, is provided.

25. The image formation apparatus of claim 1, wherein the toner retention member is a rotating roller at which the contact surface rotates.

26. The image formation apparatus of claim 1, wherein the contact surface of the toner retention member is fixed.

27. The image formation apparatus of claim 1, wherein the charging section is a contact charger to which is applied voltage in which a DC voltage is superposed with an AC voltage.

28. The image formation apparatus of claim 1, wherein the charging section is a contact charger to which only DC voltage is applied.

29. An image formation apparatus comprising:

an image-bearing body that rotates;

a charging section that charges the image-bearing body;

an exposure section that forms an electrostatic latent image on the image-bearing body that is charged;

a developing section that develops the electrostatic latent image and forms a toner image;

a transfer section that transfers the toner image to a transferred body;

a toner retention member that is provided at an upstream side of the charging section and a downstream side of the transfer section, and that includes a contact surface that contacts against the image-bearing body in surface-contact and retains transfer residue toner at the contact surface; and a cleaning section that is provided at an upstream side of the charging section and a downstream side of the toner retention member, and that removes transfer residue toner, wherein the toner retention member has plural layers structure including:

a layer of a fabric that includes the contact surface, a layer of a base member, and a layer of a resilience member disposed between the fabric and the base member.

30. An image formation apparatus comprising:

an image-bearing body that rotates;

a charging section that charges the image-bearing body;

an exposure section that forms an electrostatic latent image on the image-bearing body that is charged;

a developing section that develops the electrostatic latent image and forms a toner image;

a transfer section that transfers the toner image to a transferred body;

a toner retention member that is provided at an upstream side of the charging section and a downstream side of the transfer section, and that includes a contact surface that contacts against the image-bearing body in surface-contact and retains transfer residue toner at the contact surface; and a toner processing section that is provided at an upstream side of the charging section and a downstream side of the toner retention member, and that contacts against the image-bearing body and processes transfer residue toner, wherein the toner retention member has plural layers structure including:

a layer of a fabric that includes the contact surface, a layer of a base member, and a layer of a resilience member disposed between the fabric and the base member.

* * * * *